US009438985B2

(12) United States Patent
Dusan et al.

(10) Patent No.: US 9,438,985 B2
(45) Date of Patent: Sep. 6, 2016

(54) SYSTEM AND METHOD OF DETECTING A USER'S VOICE ACTIVITY USING AN ACCELEROMETER

(71) Applicants: Sorin V. Dusan, San Jose, CA (US); Esge B. Andersen, Campbell, CA (US); Aram Lindahl, Menlo Park, CA (US); Andrew P. Bright, San Francisco, CA (US)

(72) Inventors: Sorin V. Dusan, San Jose, CA (US); Esge B. Andersen, Campbell, CA (US); Aram Lindahl, Menlo Park, CA (US); Andrew P. Bright, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 344 days.

(21) Appl. No.: 13/631,716

(22) Filed: Sep. 28, 2012

(65) Prior Publication Data

US 2014/0093091 A1 Apr. 3, 2014

(51) Int. Cl.

| | |
|---|---|
| ***H04R 1/10*** | (2006.01) |
| *H04R 1/40* | (2006.01) |
| *H04R 3/00* | (2006.01) |

(52) U.S. Cl.

CPC ..... *H04R 1/1083* (2013.01); *H04R 1/1016* (2013.01); *H04R 1/406* (2013.01); *H04R 3/005* (2013.01); *H04R 2201/403* (2013.01); *H04R 2410/01* (2013.01); *H04R 2410/05* (2013.01); *H04R 2460/13* (2013.01)

(58) Field of Classification Search

CPC ..... H04R 3/005
USPC ..... 381/74, 92, 110
See application file for complete search history.

(56) References Cited

U.S. PATENT DOCUMENTS

| | | | |
|---|---|---|---|
| 5,692,059 | A | 11/1997 | Kruger |
| 6,006,175 | A | 12/1999 | Holzrichter |
| 7,499,686 | B2 | 3/2009 | Sinclair et al. |

(Continued)

FOREIGN PATENT DOCUMENTS

| | | | |
|---|---|---|---|
| EP | 1 489 596 | A1 | 12/2004 |

OTHER PUBLICATIONS

M. Shahidur Rahman, Atanu Saha, Tetsuya Shimamura, "Low-Frequency Band Noise Suppression Using Bone Conducted Speech", Communications, Computers and Signal Processing (PACRIM), 2011 IEEE Pacific Rim Conference on, IEEE, Aug. 23, 2011, pp. 520-525.

PCT International Search Report and Written Opinion of the International Searching Authority for PCT/US2013/058551, mailed Nov. 25, 2013.

(Continued)

*Primary Examiner* — Alexander Jamal
(74) *Attorney, Agent, or Firm* — Blakely, Sokoloff, Taylor & Zafman LLP

(57) ABSTRACT

A method of detecting a user's voice activity in a headset with a microphone array is described herein. The method starts with a voice activity detector (VAD) generating a VAD output based on acoustic signals received from microphones included in a pair of earbuds and the microphone array included on a headset wire and data output by an accelerometer that is included in the pair of earbuds. A noise suppressor may then receive the acoustic signals from the microphone array and the VAD output and suppress the noise included in the acoustic signals received from the microphone array based on the VAD output. The method may also include steering one or more beamformers based on the VAD output. Other embodiments are also described.

30 Claims, 20 Drawing Sheets

(56) References Cited

U.S. PATENT DOCUMENTS

| | | | | |
|---|---|---|---|---|
| 7,983,907 | B2 | 7/2011 | Visser et al. | |
| 8,019,091 | B2 | 9/2011 | Burnett et al. | |
| 2003/0179888 | A1 | 9/2003 | Burnett et al. | |
| 2009/0238377 | A1 | 9/2009 | Ramakrishnan et al. | |
| 2011/0010172 | A1 | 1/2011 | Konchitsky | |
| 2011/0072052 | A1* | 3/2011 | Skarin | G06Q 10/10 707/794 |
| 2011/0135120 | A1 | 6/2011 | Larsen et al. | |
| 2011/0208520 | A1 | 8/2011 | Lee | |
| 2011/0222701 | A1 | 9/2011 | Donaldson et al. | |
| 2011/0288860 | A1* | 11/2011 | Schevciw et al. | 704/233 |
| 2012/0215519 | A1 | 8/2012 | Park et al. | |
| 2012/0259628 | A1 | 10/2012 | Siotis | |
| 2012/0316869 | A1 | 12/2012 | Xiang et al. | |
| 2014/0093093 | A1 | 4/2014 | Dusan et al. | |
| 2014/0188467 | A1* | 7/2014 | Jing et al. | 704/233 |

OTHER PUBLICATIONS

Dusan, Sorin et al., "Speech Compression by Polynomial Approximation", IEEE Transactions on Audio, Speech, and Language Processing, vol. 15, No. 2, Feb. 2007, 1558-7916, pp. 387-395.

Dusan, Sorin et al., "Speech Coding Using trajectory Compression and Multiple Sensors", Center for Advanced Information Processing (CAIP), Rutgers University, Piscataway, NJ, USA, 4 pages.

Hu, Rongqiang; "Multi-Sensor Noise Suppression and Bandwidth Extension for Enhancement of Speech", A Dissertation Presented to the Academic Faculty, School of Electrical and Computer Engineering Georgia Institute of Technology, May 2006, pp. xi-xiii & 1-3.

PCT/US2013/058551 Written Opinion and Notification Concerning Transmittal of International Preliminary Report on Patentability, Mailed Apr. 9, 2015.

* cited by examiner

SYSTEM AND METHOD OF DETECTING A USER'S VOICE ACTIVITY USING AN ACCELEROMETER

FIELD

An embodiment of the invention relate generally to an electronic device having a voice activity detector (VAD) that uses signals from an accelerometer included in the earbuds of a headset with a microphone array to detect the user's speech and to steer at least one beamformer.

BACKGROUND

Currently, a number of consumer electronic devices are adapted to receive speech via microphone ports or headsets. While the typical example is a portable telecommunications device (mobile telephone), with the advent of Voice over IP (VoIP), desktop computers, laptop computers and tablet computers may also be used to perform voice communications.

When using these electronic devices, the user also has the option of using the speakerphone mode or a wired headset to receive his speech. However, a common complaint with these hands-free modes of operation is that the speech captured by the microphone port or the headset includes environmental noise such as secondary speakers in the background or other background noises. This environmental noise often renders the user's speech unintelligible and thus, degrades the quality of the voice communication.

SUMMARY

Generally, the invention relates to using signals from an accelerometer included in an earbud of an enhanced headset for use with electronic devices to detect a user's voice activity. Being placed in the user's ear canal, the accelerometer may detect speech caused by the vibrations of the user's vocal chords. Using these signals from the accelerometer in combination with the acoustic signals received by microphones in the earbuds and a microphone array in the headset wire, a coincidence defined as a "AND" function between a movement detected by the accelerometer and the voiced speech in the acoustic signals may indicate that the user's voiced speech is detected. When a coincidence is obtained, a voice activity detector (VAD) output may indicate that the user's voiced speech is detected. In addition to the user's voiced speech, the user's speech may also include unvoiced speech, which is speech that is generated without vocal chord vibrations (e.g., sounds such as /s/, /sh/, /f/). In order for the VAD output to indicate that unvoiced speech is detected, a signal from a microphone in the earbuds or a microphone in the microphone array or the output of a beamformer may be used. A high-pass filter is applied to the signal from the microphone or beamformer and if the resulting power is above a threshold, the VAD output may indicate the user's unvoiced speech is detected. A noise suppressor may receive the acoustic signals as received from the microphone array beamformer and may suppress the noise from the acoustic signals or beamformer based on the VAD output. Further, based on this VAD output, one or more beamformers may also be steered such that the microphones in the earbuds and in the microphone array emphasize the user's speech signals and deemphasize the environmental noise.

In one embodiment of the invention, a method of detecting a user's voice activity in a headset with a microphone array starts with a voice activity detector (VAD) generating a VAD output based on (i) acoustic signals received from microphones included in a pair of earbuds and the microphone array included on a headset wire and (ii) data output by a sensor detecting movement that is included in the pair of earbuds. The headset may include the pair of earbuds and the headset wire. The VAD output may be generated by detecting speech included in the acoustic signals, detecting a user's speech vibrations from the data output by the accelerometer, coincidence of the detected speech in acoustic signals and the user's speech vibrations, and setting the VAD output to indicate that the user's voiced speech is detected if the coincidence is detected and setting the VAD output to indicate that the user's voiced speech is not detected if the coincidence is not detected. A noise suppressor may then receive (i) the acoustic signals from the microphone array and (ii) the VAD output and suppress the noise included in the acoustic signals received from the microphone array based on the VAD output. The method may also include steering one or more beamformers based on the VAD output. The beamformers may be adaptively steered or the beamformers may be fixed and steered to a set location.

In another embodiment of the invention, a system detecting a user's voice activity comprises a headset, a voice activity detector (VAD) and a noise suppressor. The headset may include a pair of earbuds and a headset wire. Each of the earbuds may include earbud microphones and a sensor detecting movement such as an accelerometer. The headset wire may include a microphone array. The VAD may be coupled to the headset and may generate a VAD output based on (i) acoustic signals received from the earbud microphones, the microphone array or beamformer and (ii) data output by the sensor detecting movement. The noise suppressor may be coupled to the headset and the VAD and may suppress noise from the acoustic signals from the microphone array based on the VAD output.

The above summary does not include an exhaustive list of all aspects of the present invention. It is contemplated that the invention includes all systems, apparatuses and methods that can be practiced from all suitable combinations of the various aspects summarized above, as well as those disclosed in the Detailed Description below and particularly pointed out in the claims filed with the application. Such combinations may have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one. In the drawings.

DETAILED DESCRIPTION

In the following description, numerous specific details are set forth. However, it is understood that embodiments of the invention may be practiced without these specific details. In other instances, well-known circuits, structures, and techniques have not been shown to avoid obscuring the understanding of this description.

Moreover, the following embodiments of the invention may be described as a process, which is usually depicted as a flowchart, a flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed. A process may correspond to a method, a procedure, etc.

Figure 1:
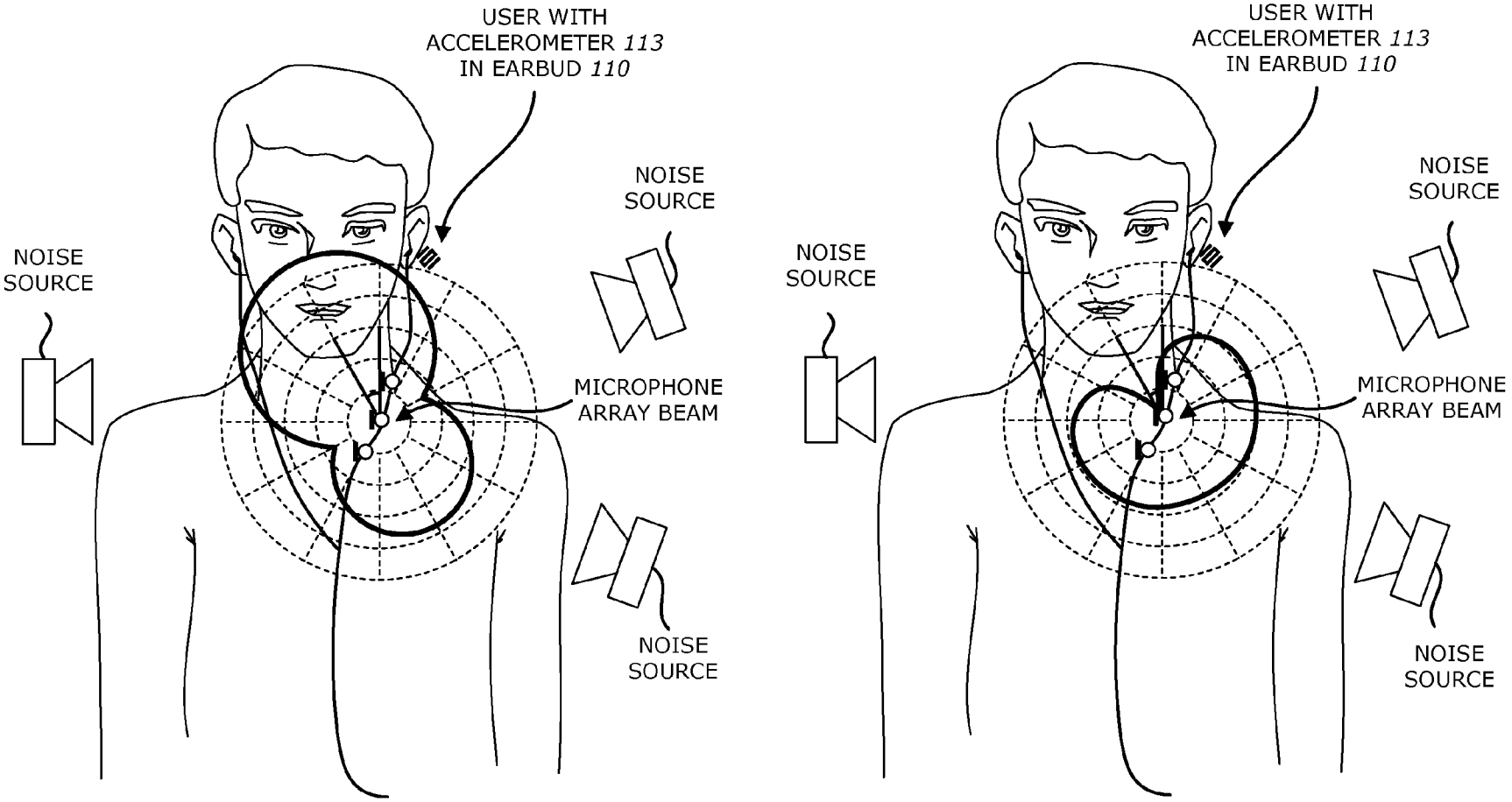
FIG. 1 illustrates an example of the headset in use according to one embodiment of the invention.
Figure 2:
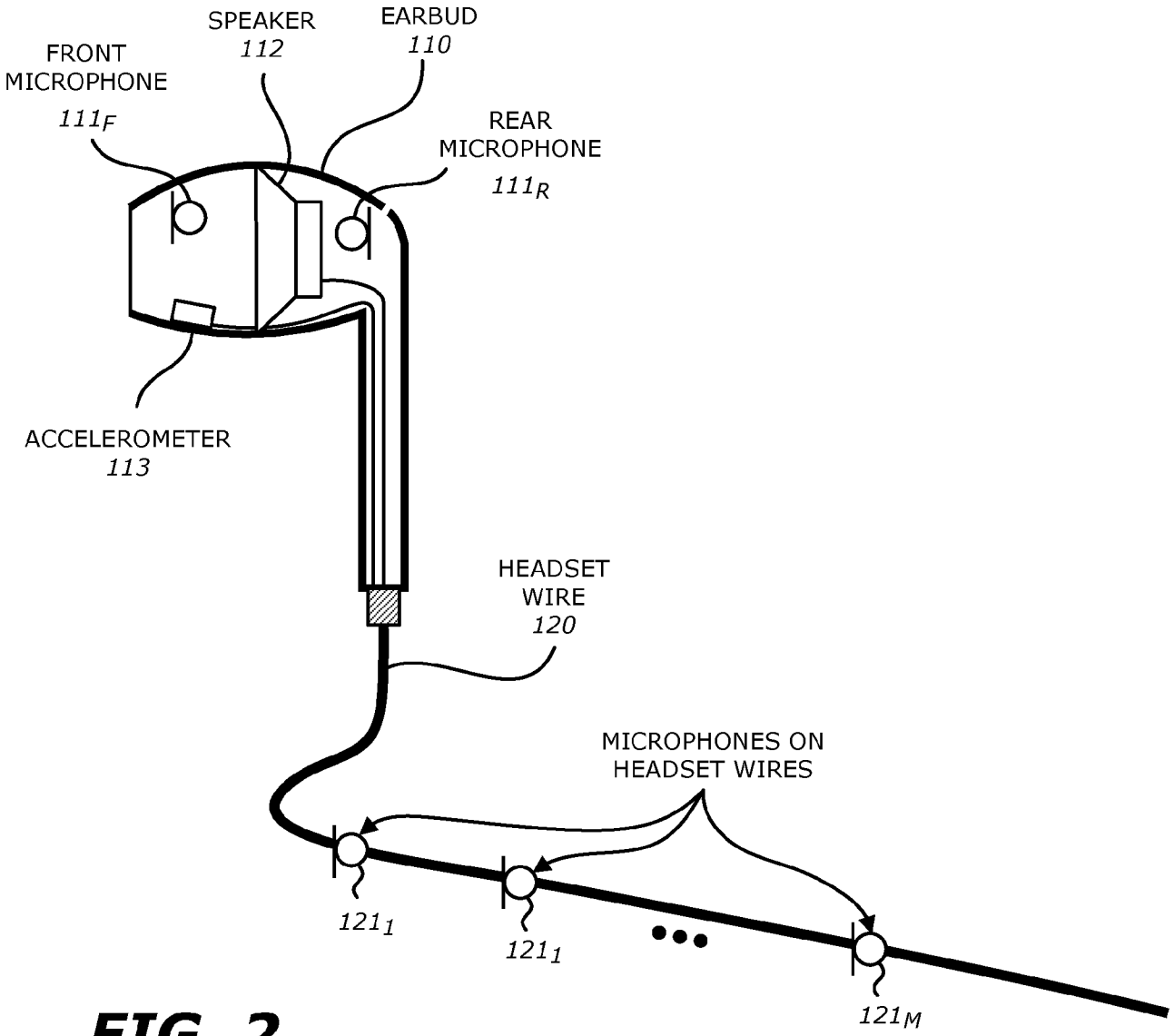
FIG. 2 illustrates an example of the right side of the headset used with a consumer electronic device in which an embodiment of the invention may be implemented.

FIG. 1 illustrates an example of a headset in use that may be coupled with a consumer electronic device according to one embodiment of the invention. As shown in FIG. 1, the headset 100 includes a pair of earbuds 110 and a headset wire 120. The user may place one or both the earbuds 110 into his ears and the microphones in the headset may receive his speech. The microphones may be air interface sound pickup devices that convert sound into an electrical signal. The headset 100 in FIG. 1 is double-earpiece headset. It is understood that single-earpiece or monaural headsets may also be used. As the user is using the headset to transmit his speech, environmental noise may also be present (e.g., noise sources in FIG. 1). While the headset 100 in FIG. 2 is an in-ear type of headset that includes a pair of earbuds 110 which are placed inside the user's ears, respectively, it is understood that headsets that include a pair of earcups that are placed over the user's ears may also be used. Additionally, embodiments of the invention may also use other types of headsets.

FIG. 2 illustrates an example of the right side of the headset used with a consumer electronic device in which an embodiment of the invention may be implemented. It is understood that a similar configuration may be included in the left side of the headset 100.

As shown in FIG. 2, the earbud 110 includes a speaker 112, a sensor detecting movement such as an accelerometer 113, a front microphone $\mathbf{111}_F$ that faces the direction of the eardrum and a rear microphone $\mathbf{111}_R$ that faces the opposite direction of the eardrum. The earbud 110 is coupled to the headset wire 120, which may include a plurality of microphones $\mathbf{121}_1$-$\mathbf{121}_M$ (M>1) distributed along the headset wire that can form one or more microphone arrays. As shown in FIG. 1, the microphone arrays in the headset wire 120 may be used to create microphone array beams (i.e., beamformers) which can be steered to a given direction by emphasizing and deemphasizing selected microphones $\mathbf{121}_1$-$\mathbf{121}_M$. Similarly, the microphone arrays can also exhibit or provide nulls in other given directions. Accordingly, the beamforming process, also referred to as spatial filtering, may be a signal processing technique using the microphone array for directional sound reception. The headset 100 may also include one or more integrated circuits and a jack to connect the headset 100 to the electronic device (not shown) using digital signals, which may be sampled and quantized.

When the user speaks, his speech signals may include voiced speech and unvoiced speech. Voiced speech is speech that is generated with excitation or vibration of the user's vocal chords. In contrast, unvoiced speech is speech that is generated without excitation of the user's vocal chords. For example, unvoiced speech sounds include /s/, /sh/, /f/, etc. Accordingly, in some embodiments, both the types of speech (voiced and unvoiced) are detected in order to generate an augmented voice activity detector (VAD) output which more faithfully represents the user's speech.

First, in order to detect the user's voiced speech, in one embodiment of the invention, the output data signal from accelerometer 113 placed in each earbud 110 together with the signals from the front microphone $\mathbf{111}_F$, the rear microphone $\mathbf{111}_R$, the microphone array $\mathbf{121}_1$-$\mathbf{121}_M$ or the beamformer may be used. The accelerometer 113 may be a sensing device that measures proper acceleration in three directions, X, Y, and Z or in only one or two directions. When the user is speaking voiced speech, the vibrations of the user's vocal chords may cause the vibrations in the bones of the user's head which is detected by the accelerometer 113 in the headset 110. In other embodiments, an inertial sensor, a force sensor or a position, orientation and movement sensor may be used in lieu of the accelerometer 113 in the headset 110.

In the embodiment with the accelerometer 113, the accelerometer 113 is used to detect the low frequencies since the low frequencies include the user's voiced speech signals. For example, the accelerometer 113 may be tuned such that it is sensitive to the frequency band range that is below 2000 Hz. In one embodiment, the signals below 60 Hz-70 Hz may be filtered out using a high-pass filter and above 2000 Hz-3000 Hz may be filtered out using a low-pass filter. In one embodiment, the sampling rate of the accelerometer may be 2000 Hz but in other embodiments, the sampling rate may be between 4000 Hz to 6000 Hz. It is understood that the dynamic range may be optimized to provide more resolution within a forced range that is expected to be produced by the bone conduction effect in the headset 100. Based on the outputs of the accelerometer 113, an accelerometer-based VAD output (VADa) may be generated, which indicates whether or not the accelerometer 113 detected speech generated by the vibrations of the vocal chords. In one embodiment, the power or energy level of the outputs of the accelerometer 113 is assessed to determine whether the vibration of the vocal chords is detected. The power may be compared to a threshold level that indicates the vibrations are found in the outputs of the accelerometer 113. In another embodiment, the VADa signal indicating voiced speech is computed using the normalized cross-correlation between any pair of the accelerometer signals (e.g. X and Y, X and Z, or Y and Z). If the cross-correlation has values exceeding a threshold within a short delay interval the VADa indicates that the voiced speech is detected. In some embodiments, the VADa is a binary output that is generated as a voice activity detector (VAD), wherein 1 indicates that the vibrations of the vocal chords have been detected and 0 indicates that no vibrations of the vocal chords have been detected.

Using at least one of the microphones in the headset 110 (e.g., one of the microphones in the microphone array $\mathbf{121}_1$-$\mathbf{121}_M$, front earbud microphone $\mathbf{111}_F$, or back earbud microphone $\mathbf{111}_R$) or the output of a beamformer, a microphone-based VAD output (VADm) may be generated by the VAD to indicate whether or not voiced speech is detected. This determination may be based on an analysis of the power or energy present in the acoustic signal received by the microphone. The power in the acoustic signal may be compared to a threshold that indicates that voiced speech is present. In some embodiments, the VADm is a binary output that is generated as a voice activity detector (VAD), wherein 1 indicates that the voiced speech has been detected in the acoustic signals and 0 indicates that no voiced speech has been detected in the acoustic signals.

Both the VADa and the VADm may be subject to erroneous detections of voiced speech. For instance, the VADa may falsely identify the movement of the user or the headset 100 as being vibrations of the vocal chords while the VADm may falsely identify noises in the environment as being voiced speech in the acoustic signals. Accordingly, in one embodiment, the VAD output (VADv) is set to indicate that the user's voiced speech is detected (e.g., VADv output is set to 1) if the coincidence between the detected speech in acoustic signals (e.g., VADm) and the user's speech vibrations from the accelerometer output data signals is detected (e.g., VADa). Conversely, the VAD output is set to indicate that the user's voiced speech is not detected (e.g., VADv output is set to 0) if this coincidence is not detected. In other words, the VADv output is obtained by applying an AND function to the VADa and VADm outputs.

Second, the signal from at least one of the microphones in the headset 100 or the output from the beamformer may be used to generate a VAD output for unvoiced speech (VADu), which indicates whether or not unvoiced speech is detected. It is understood that the VADu output may be affected by environmental noise since it is computed only based on an analysis of the acoustic signals received from a microphone in the headset 100 or from the beamformer. In one embodiment, the signal from the microphone closest in proximity to the user's mouth or the output of the beamformer is used to generate the VADu output. In this embodiment, the VAD may apply a high-pass filter to this signal to compute high frequency energies from the microphone or beamformer signal. When the energy envelope in the high frequency band (e.g. between 2000 Hz and 8000 Hz) is above certain threshold the VADu signal is set to 1 to indicate that unvoiced speech is present. Otherwise, the VADu signal may be set to 0 to indicate that unvoiced speech is not detected. Voiced speech can also set VADu to 1 if significant energy is detected at high frequencies. This has no negative consequences since the VADv and VADu are further combined in an "OR" manner as described below.

Accordingly, in order to take into account both the voiced and unvoiced speech and to further be more robust to errors, the method may generate a VAD output by combining the VADv and VADu outputs using an OR function. In other words, the VAD output may be augmented to indicate that the user's speech is detected when VADv indicates that voiced speech is detected or VADu indicates that unvoiced speech is detected. Further, when this augmented VAD output is 0, this indicates that the user is not speaking and thus a noise suppressor may apply a supplementary attenuation to the acoustic signals received from the microphones or from beamformer in order to achieve additional suppression of the environmental noise.

The VAD output may be used in a number of ways. For instance, in one embodiment, a noise suppressor may estimate the user's speech when the VAD output is set to 1 and may estimate the environmental noise when the VAD output is set to 0. In another embodiment, when the VAD output is set to 1, one microphone array may detect the direction of the user's mouth and steer a beamformer in the direction of the user's mouth to capture the user's speech while another microphone array may steer a cardioid beamforming pattern in the opposite direction of the user's mouth to capture the environmental noise with as little contamination of the user's speech as possible. In this embodiment, when the VAD output is set to 0, one or more microphone arrays may detect the direction and steer a second beamformer in the direction of the main noise source or in the direction of the individual noise sources from the environment.

The latter embodiment is illustrated in FIG. 1, the user in the left part of FIG. 1 is speaking while the user in the right part of FIG. 1 is not speaking. When the VAD output is set to 1, at least one of the microphone arrays is enabled to detect the direction of the user's mouth. The same or another microphone array creates a beamforming pattern in the direction of the user's mouth, which is used to capture the user's speech. Accordingly, the beamformer outputs an enhanced speech signal. When the VAD output is 0, the same or another microphone array may create a cardioid beamforming pattern in the direction opposite to the user's mouth, which is used to capture the environmental noise. When the VAD output is 0, other microphone arrays may create beamforming patterns (not shown in FIG. 1) in the directions of individual environmental noise sources. When the VAD output is 0, the microphone arrays is not enabled to detect the direction of the user's mouth, but rather the beamformer is maintained at its previous setting. In this manner, the VAD output is used to detect and track both the user's speech and the environmental noise.

The microphone arrays are generating beams in the direction of the mouth of the user in the left part of FIG. 1 to capture the user's speech and in the direction opposite to the direction of the user's mouth in the right part of FIG. 1 to capture the environmental noise.

Figure 3:
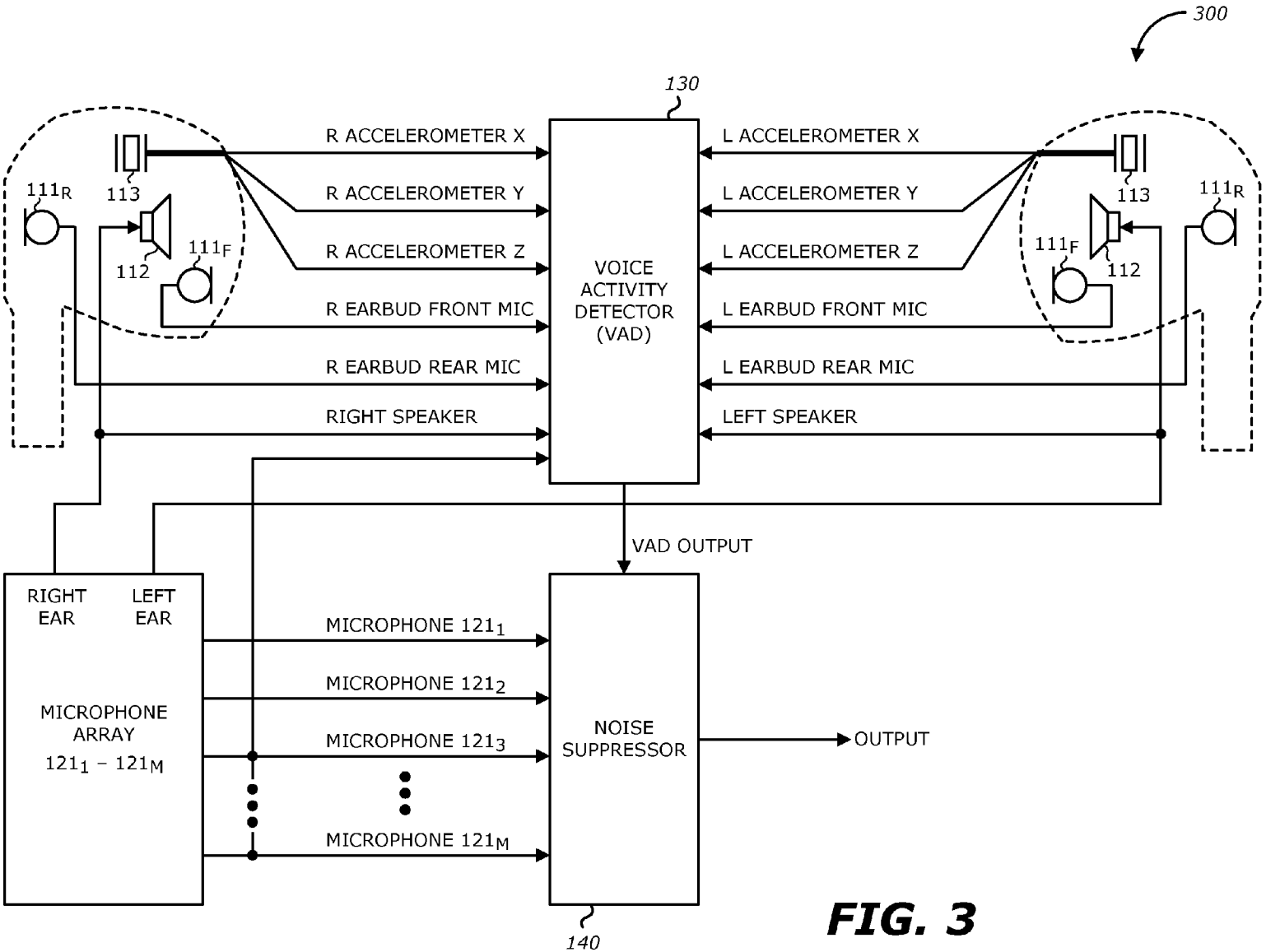
FIG. 3 illustrates a block diagram of a system detecting a user's voice activity according to a first embodiment of the invention.

FIG. 3 illustrates a block diagram of a system detecting a user's voice activity according to a first embodiment of the invention. The system 300 in FIG. 3 includes the headset 100 having the pair of earbuds 110 and the headset wire 120 and an electronic device that includes a VAD 130 and a noise suppressor 140. As shown in FIG. 3, the VAD 130 receives the accelerometer's 113 output signals that provide information on sensed movement in the x, y, and z directions and the acoustic signals received from the microphones $\mathbf{111}_F$, $\mathbf{111}_R$ and microphone array $\mathbf{121}_1$-$\mathbf{121}_M$. It is understood that a plurality of microphone arrays (beamformers) on the headset wire 120 may also provide acoustic signals to the VAD 130 and the noise suppressor 140.

The accelerometer signals may be first pre-conditioned. First, the accelerometer signals are pre-conditioned by removing the DC component and the low frequency components by applying a high pass filter with a cut-off frequency of 60 Hz-70 Hz, for example. Second, the stationary noise is removed from the accelerometer signals by applying a spectral subtraction method for noise suppression. Third, the cross-talk or echo introduced in the accelerometer signals by the speakers in the earbuds may also be removed. This cross-talk or echo suppression can employ any known methods for echo cancellation. Once the accelerometer signals are pre-conditioned, the VAD 130 may use these signals to generate the VAD output. In one embodiment, the VAD output is generated by using one of the X, Y, Z accelerometer signals which shows the highest sensitivity to the user's speech or by adding the energies of the accelerometer signals and computing the power envelope for the resulting signal. When the power envelope is above a given threshold, the VAD output is set to 1, otherwise is set to 0. In another embodiment, the VAD signal indicating voiced speech is computed using the normalized cross-correlation between any pair of the accelerometer signals (e.g. X and Y, X and Z, or Y and Z). If the cross-correlation has values exceeding a threshold within a short delay interval the VAD indicates that the voiced speech is detected. In another embodiment, the VAD output is generated by computing the coincidence as a "AND" function between the VADm from one of the microphone signals or beamformer output and the VADa from one or more of the accelerometer signals (VADa). This coincidence between the VADm from the microphones and the VADa from the accelerometer signals ensures that the VAD is set to 1 only when both signals display significant correlated energy, such as the case when the user is speaking. In another embodiment, when at least one of the accelerometer signal (e.g., x, y, z) indicates that user's speech is detected and is greater than a required threshold and the acoustic signals received from the microphones also indicates that user's speech is detected and is also greater than the required threshold, the VAD output is set to 1, otherwise is set to 0.

The noise suppressor 140 receives and uses the VAD output to estimate the noise from the vicinity of the user and remove the noise from the signals captured by at least one of the microphones $\mathbf{121}_1$-$\mathbf{121}_M$ in the microphone array. By using the data signals outputted from the accelerometers 113 further increases the accuracy of the VAD output and hence, the noise suppression. Since the acoustic signals received from the microphones $\mathbf{121}_1$-$\mathbf{121}_M$ and $\mathbf{111}_F$, $\mathbf{111}_R$ may wrongly indicate that speech is detected when, in fact, environmental noises including voices (i.e., distractors or second talkers) in the background are detected, the VAD 130 may more accurately detect the user's voiced speech by looking for coincidence of vibrations of the user's vocal chords in the data signals from the accelerometers 113 when the acoustic signals indicate a positive detection of speech.

Figure 4:
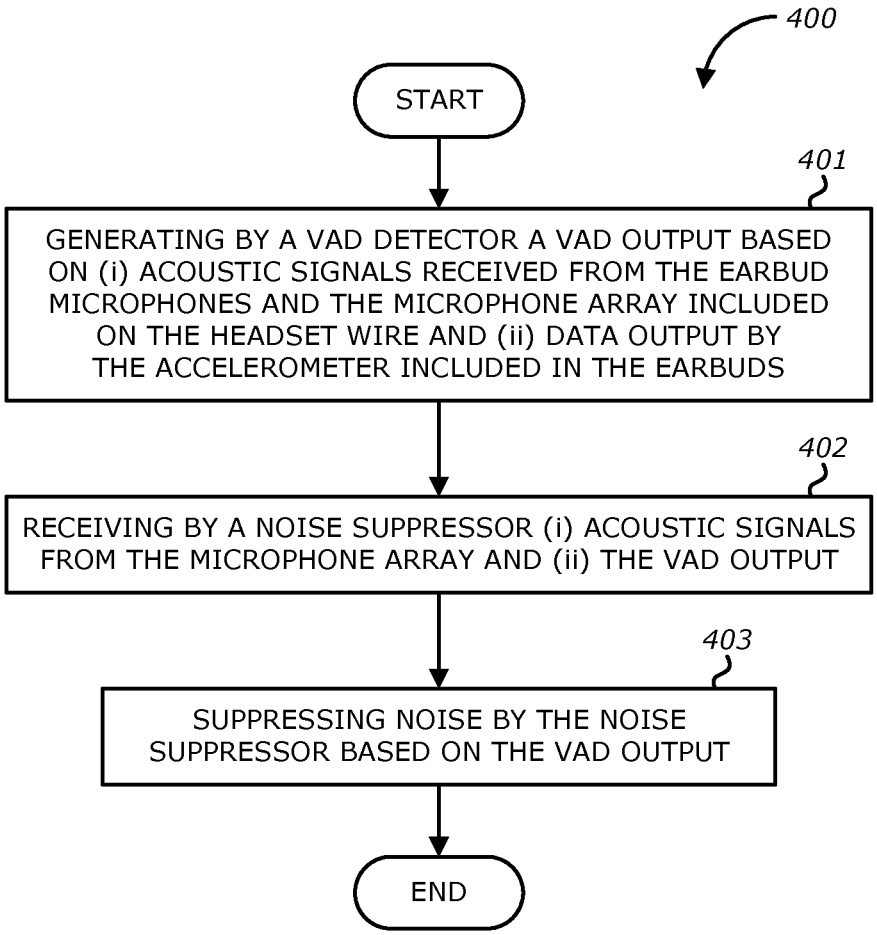
FIG. 4 illustrates a flow diagram of an example method of detecting a user's voice activity according to the first embodiment of the invention.

FIG. 4 illustrates a flow diagram of an example method of detecting a user's voice activity according to the first embodiment of the invention. Method 400 starts with a VAD detector 130 generating a VAD output based on (i) acoustic signals received from microphones $\mathbf{111}_F$, $\mathbf{111}_R$ included in a pair of earbuds 110 and the microphone array $\mathbf{121}_1$-$\mathbf{121}_M$ included on a headset wire 120 and (ii) data output by a sensor detecting movement 113 that is included in the pair of earbuds 120 (Block 401). At Block 402, a noise suppressor 140 receives the acoustic signals from the microphone array $\mathbf{121}_1$-$\mathbf{121}_M$ and (ii) the VAD output from the VAD detector 130. At Block 403, the noise suppressor may suppress the noise included in the acoustic signals received from the microphone array $\mathbf{121}_1$-$\mathbf{121}_M$ based on the VAD output.

Figure 5:
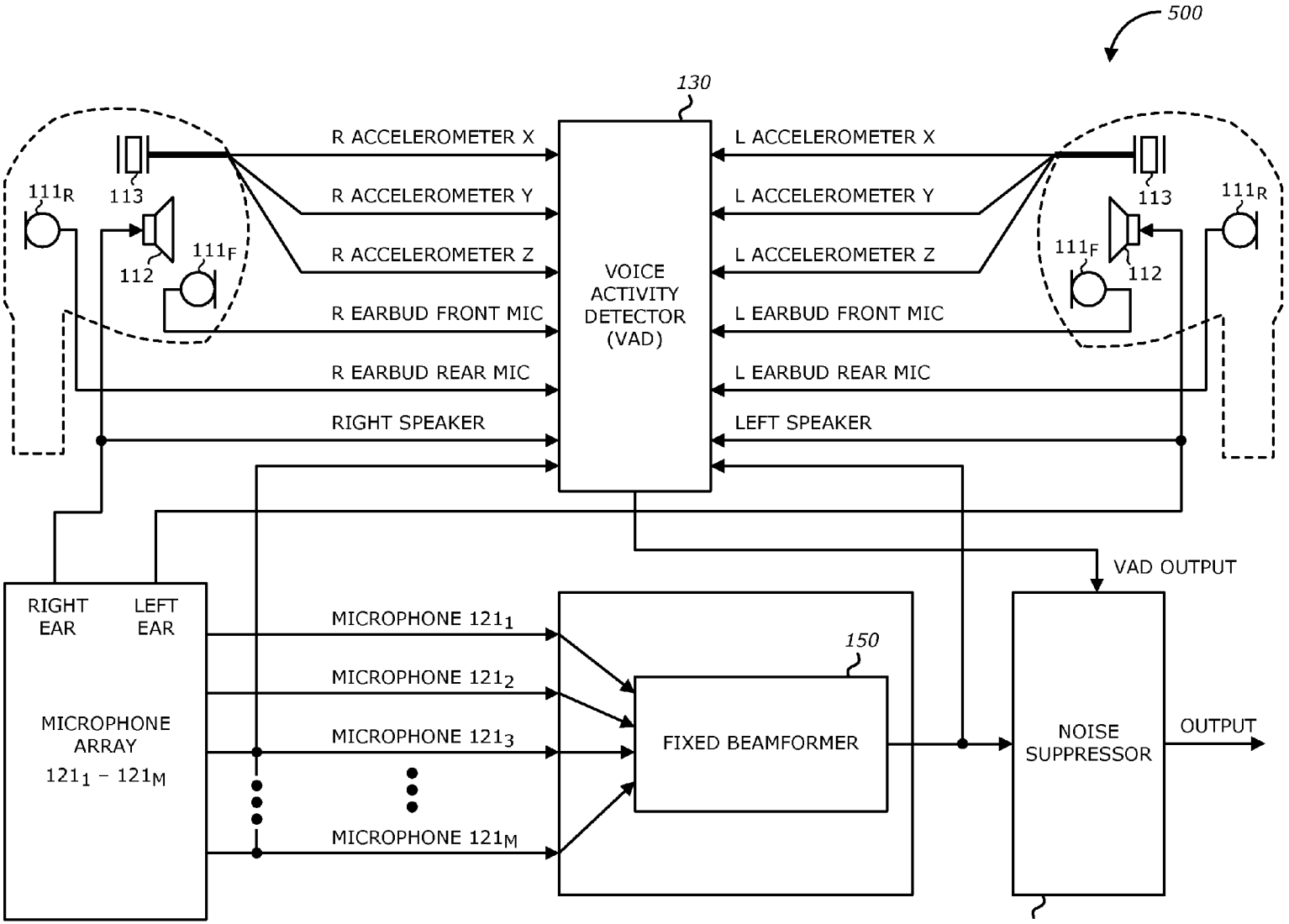
FIG. 5 illustrates a block diagram of a system detecting a user's voice activity according to a second embodiment of the invention.

FIG. 5 illustrates a block diagram of a system detecting a user's voice activity according to a second embodiment of the invention. The system 500 is similar to the system 300 in FIG. 3 but further includes a fixed beamformer 150 to receive the acoustic signals received from the microphone array $\mathbf{121}_1$-$\mathbf{121}_M$ and its output is provided to the noise suppressor 140 and to the VAD Block 130. The fixed beamformer is steered in a direction of the user's mouth during a normal wearing position of the headset. This direction may be pre-defined setting in the headset 100. By steering the fixed beamformer in the direction of the user's mouth during a normal wearing position, the fixed beamformer may provide the user's speech signal with significant attenuation of the noises in the environment. Accordingly, the fixed beamformer outputs a main speech signal to the noise suppressor 140. In other embodiments, the microphone array based on the microphones $\mathbf{111}_F$, $\mathbf{111}_R$ in the earbuds 110 and the plurality of microphones $\mathbf{121}_1$-$\mathbf{121}_M$ are generating and steering the fixed beamformer 150 in the direction of the mouth of the user as corresponding to normal wearing conditions.

Figure 6:
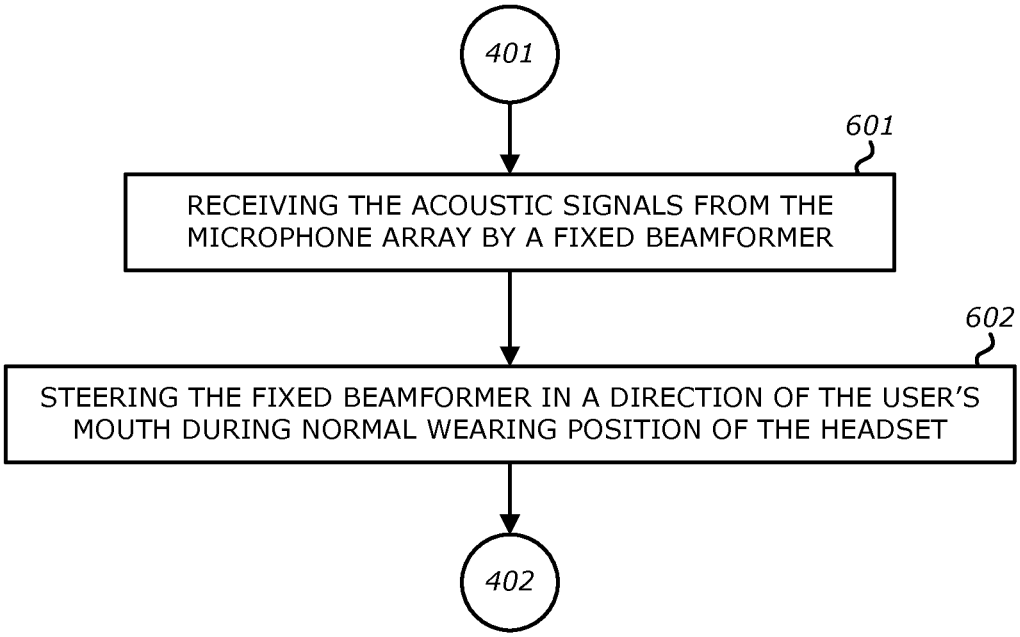
FIG. 6 illustrates a flow diagram of an example method of detecting a user's voice activity according to the second embodiment of the invention.

FIG. 6 illustrates a flow diagram of an example method of detecting a user's voice activity according to the second embodiment of the invention. In this embodiment, after the VAD output is generated at Block 401 in FIG. 4, the fixed beamformer 150 receives the acoustic signals from the microphone array at Block 601. The fixed beamformer 150 is then steered in the direction of the user's mouth during normal wearing position of the headset at Block 602 and the noise suppressor 140 receives the acoustic signals as outputted by the fixed beamformer 150 (i.e., the main speech signal). In this embodiment, the noise suppressor 140 may suppress the noise included in the acoustic signals as outputted by the fixed beamformer 150 as using the additional information in the VAD output received from the VAD 130.

Figure 7:
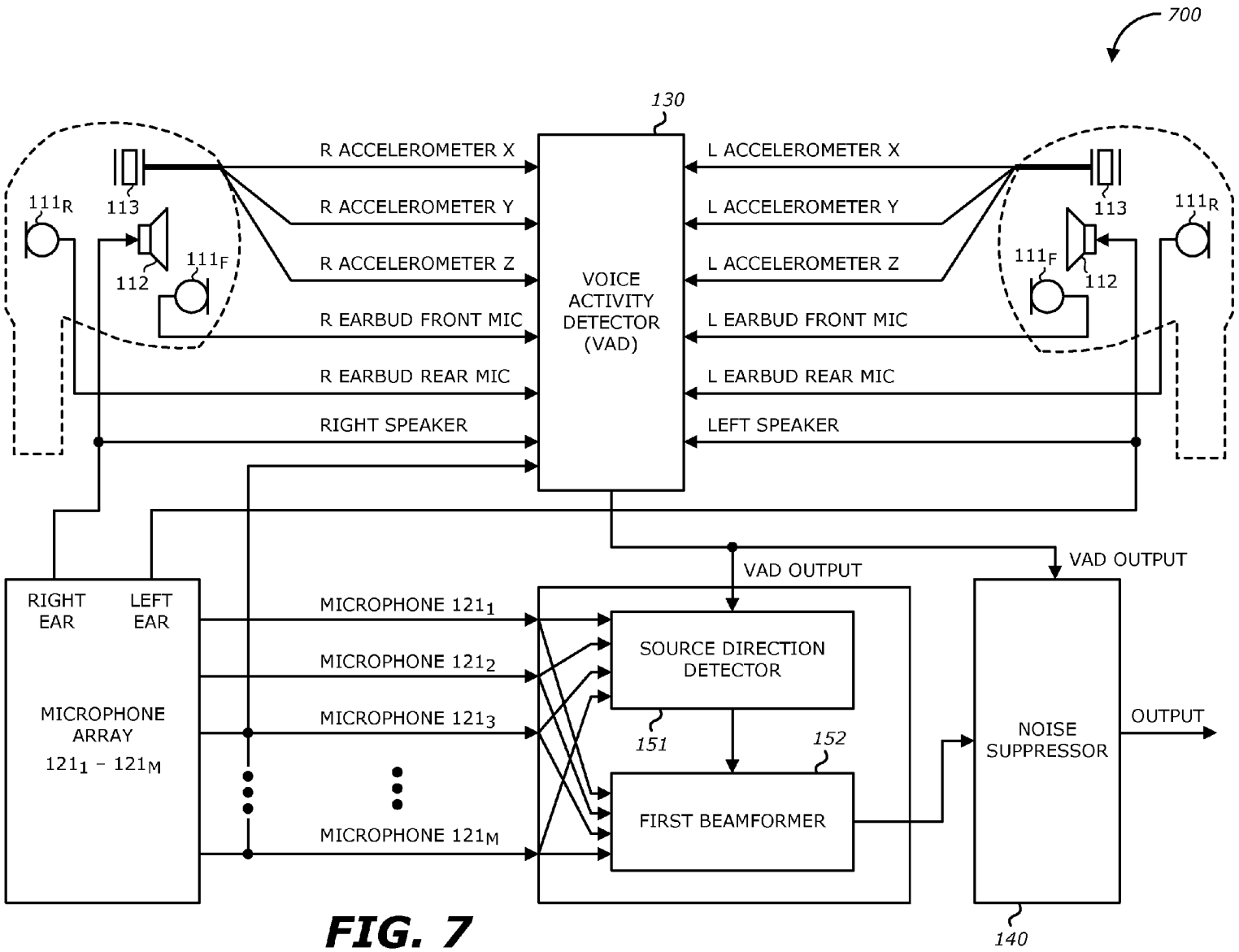
FIG. 7 illustrates a block diagram of a system detecting a user's voice activity according to a third embodiment of the invention.

FIG. 7 illustrates a block diagram of a system detecting a user's voice activity according to a third embodiment of the invention. Due to the user's movements and changing positions the headset 100 and the microphone arrays $\mathbf{121}_1$-$\mathbf{121}_M$ included therein may also change orientation with regards to the user's mouth. Thus, system 700 is similar to the system 300 in FIG. 3 but further includes a source direction detector 151 and a first beamformer 152 to implement voice-tracking principles. As shown in FIG. 7, the source direction detector 151 also receives the VAD output from the VAD 130 as well as the acoustic signals from the microphone array $\mathbf{121}_1$-

$121_M$. The source direction detector 151 may detect the user's speech source based on the VAD output and provide the direction of the user's speech source to the first beamformer 152. For instance, when the VAD output is set to indicate that the user's speech is detected (e.g., VAD output is set to 1), the source direction detector 151 estimates the direction of the user's mouth relative to the microphone array $121_1$-$121_M$. Using this directional information from the source direction detector 151, when the VAD output is set to 1, the first beamformer 152 is adaptively steered in the direction of the user's speech source. The output of the first beamformer 152 may be the acoustic signals from the microphone array $121_1$-$121_M$ as captured by the first beamformer 152. As shown in FIG. 7, the output of the first beamformer 152 may be the main speech signal that is then provided to the noise suppressor 140. Accordingly, when the VAD output is set to 1, the source direction detector 151 computes the direction of user's mouth. Thus, the microphone array's beam direction can be adaptively adjusted when the VAD output is set to 1 to track the user's mouth direction. When the VAD output indicates that the user's speech is not detected (e.g., VAD output set to 0), the direction of the first beamformer 152 may be maintained at the direction corresponding to its position the last time the VAD output was set to 1.

In one embodiment, the source direction detector 151 may perform acoustic source localization based on time-delay estimates in which pairs of microphones included in the plurality of microphones $121_1$-$121_M$ and $111_F$, $111_R$ in the headset 100 are used to estimate the delay for the sound signal between the two of the microphones. The delays from the pairs of microphones may also be combined and used to estimate the source location using methods such as the generalized cross-correlation (GCC) or adaptive eigenvalue decomposition (AED). In another embodiment, the source direction detector 151 and the first beamformer 152 may work in conjunction to perform the source localization based on steered beamforming (SBF). In this embodiment, the first beamformer 152 is steered over a range of directions and for each direction the power of the beamforming output is calculated. The power of the first beamformer 152 for each direction in the range of directions is calculated and the user's speech source is detected as the direction that has the highest power.

As shown in FIG. 7, the noise suppressor 140 receives the output from the first beamformer 152 which is a main speech signal (i.e., the acoustic signals from the microphone array $121_1$-$121_M$ as captured by the first beamformer 152). In this embodiment, the noise suppressor 140 may suppress the noise included in the main speech signal based on the VAD output.

Figure 8:
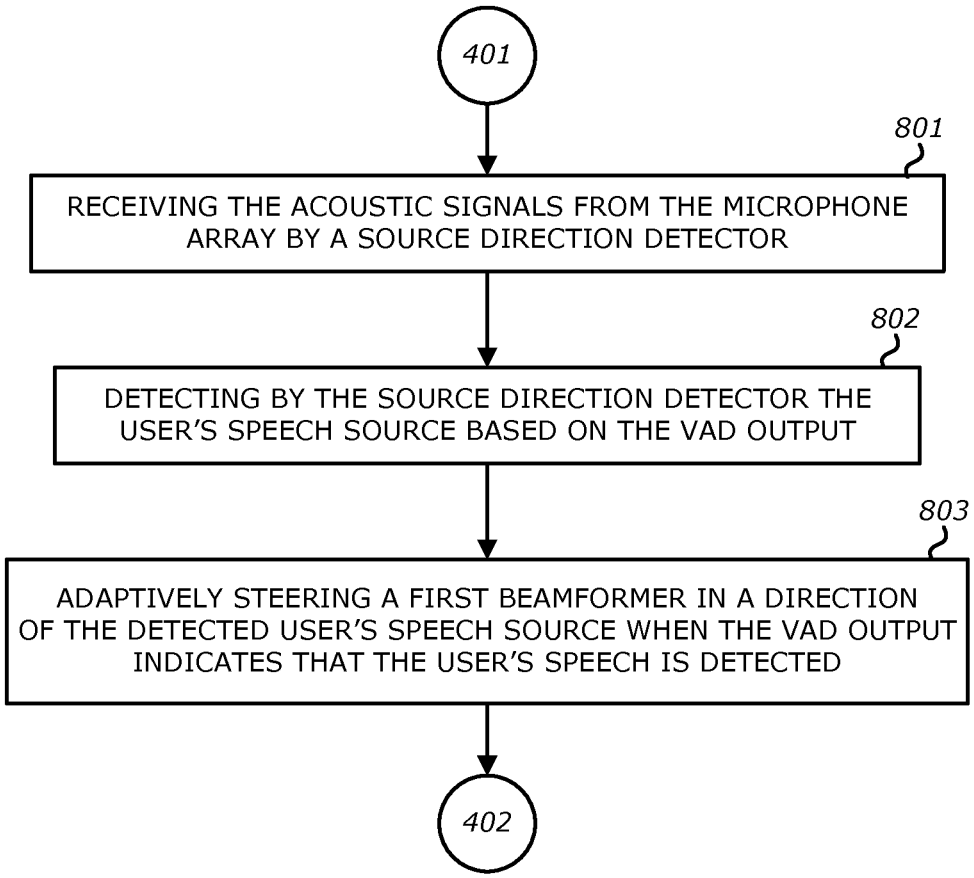
FIG. 8 illustrates a flow diagram of an example method of detecting a user's voice activity according to the third embodiment of the invention.

FIG. 8 illustrates a flow diagram of an example method of detecting a user's voice activity according to the third embodiment of the invention. In this embodiment, after the VAD output is generated at Block 401 in FIG. 4, the source direction detector 151 receives the acoustic signals from the microphone array $121_1$-$121_M$ at Block 801 and detects the user's speech source based on the VAD output at Block 802. When the VAD output is set to indicate that the user's speech is detected, the first beamformer is adaptively steered in the direction of the detected user's speech source at Block 803. In this embodiment, the noise suppressor 140 may suppress the noise included in the acoustic signals as outputted by the first beamformer 152 (i.e., the main speech signal) based on the VAD output received from the VAD 130.

Figure 9:
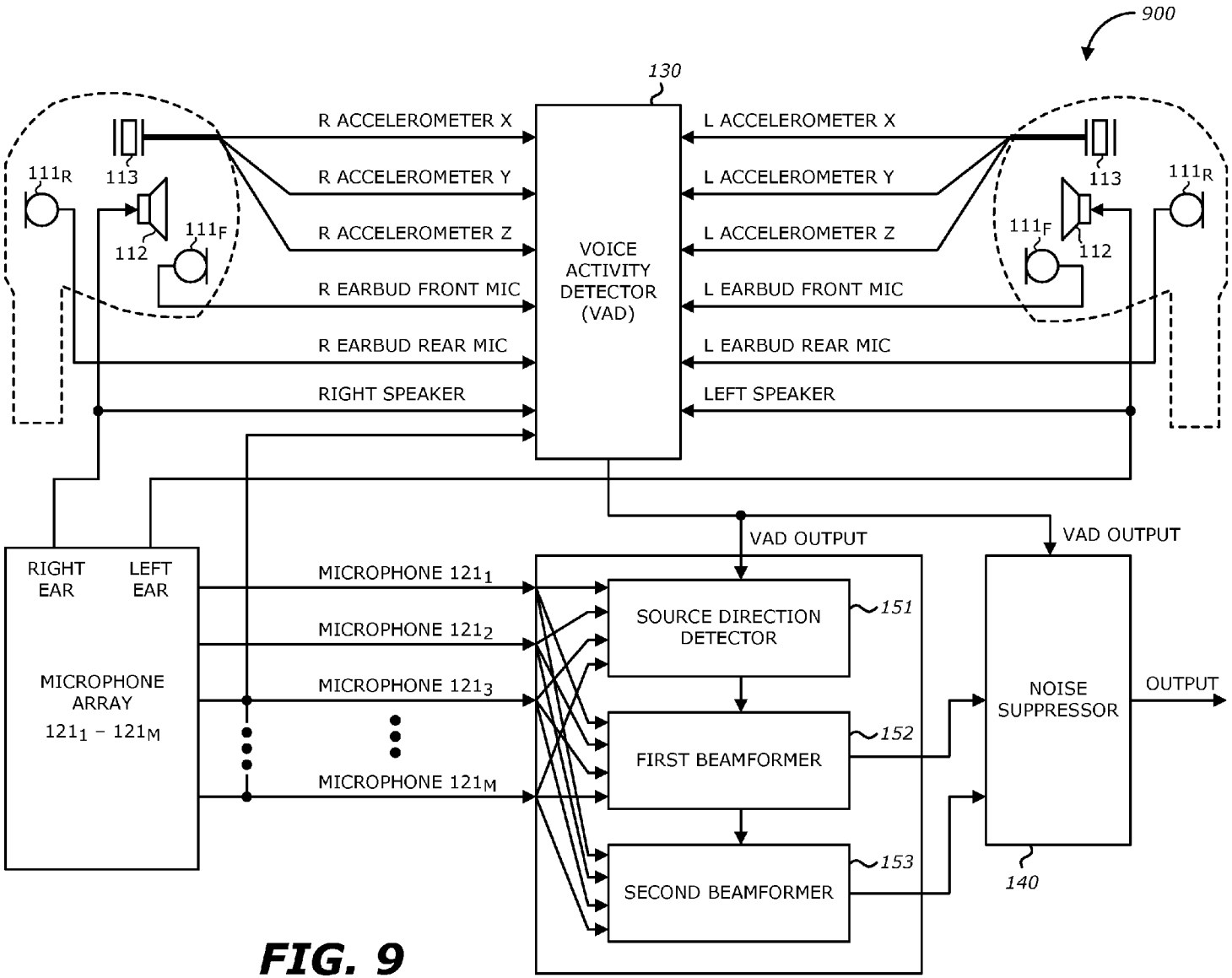
FIG. 9 illustrates a block diagram of a system detecting a user's voice activity according to a fourth embodiment of the invention.

FIG. 9 illustrates a block diagram of a system detecting a user's voice activity according to a fourth embodiment of the invention. System 900 is similar to the system 700 in FIG. 7 but further includes a second beamformer 153 to provide a noise estimation of the environment noise that is present in the acoustic signals from the microphone array $121_1$-$121_M$. As shown in FIG. 9, the second beamformer 153 may have a cardioid pattern and may be adaptively steered with a null towards the mouth direction. In other words, the second beamformer 153 may be adaptively steered in a direction opposite to the mouth's direction to provide a signal representing an estimate of the environmental noise.

As shown in FIG. 9, the noise suppressor 140 in this embodiment receives the outputs from the first beamformer 152 and the second beamformer 153 as well as the VAD output. Thus, the noise estimate from the second beamformer is provided to the noise suppressor 140 together with the user's speech signal included in the acoustic signals as outputted by the first beamformer. In this embodiment, the noise suppressor 140 may further suppress the noise included in the main speech signal outputted from the first beamformer 152 based on the outputs of the second beamformer 153 (i.e., the signal representing the environmental noise) and the VAD output.

Referring back to FIG. 1, the adaptively steered first beamformer is illustrated on the left side of FIG. 1 while the adaptively steered second beamformer is illustrated on the right side of FIG. 1. In this example, when the VAD output is set to 1, the first beamformer may be adaptively steered towards the user's mouth (e.g., left side of FIG. 1) and the second different beamformer may be adaptively steered to form a cardioid pattern in the direction opposite to the user's mouth (e.g., right side of FIG. 1). When the VAD output is set to 0, both the first and second beamformers 152, 153 may be maintained at the directions corresponding to their respective positions the last time the VAD output was set to 1.

Figure 10:
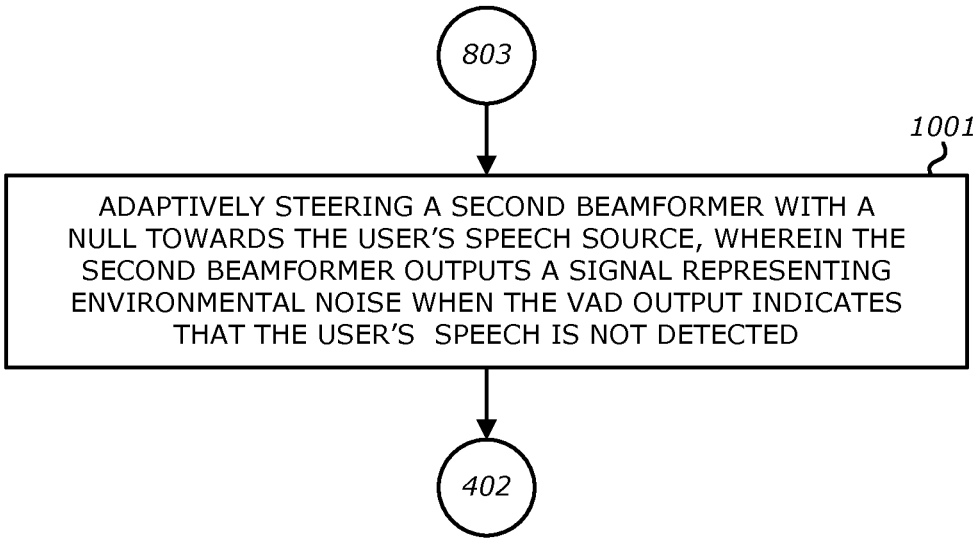
FIG. 10 illustrates a flow diagram of an example method of detecting a user's voice activity according to the fourth embodiment of the invention.

FIG. 10 illustrates a flow diagram of an example method of detecting a user's voice activity according to the fourth embodiment of the invention. In this embodiment, after the first beamformer is adaptively steered in the direction of the detected user's speech source at Block 803 in FIG. 8, the second beamformer 153 is adaptively steered with a null towards the detected user's speech source. In this embodiment, the second beamformer has a cardioid pattern and outputs a signal representing environmental noise when the VAD output is set to indicate that the user's speech is not detected. In this embodiment, the noise suppressor 140 may suppress the noise included in the main speech signal as outputted by the first beamformer 152 based on the noise estimate as outputted from the second beamformer 153 and the VAD output received from the VAD 130.

Figure 11:
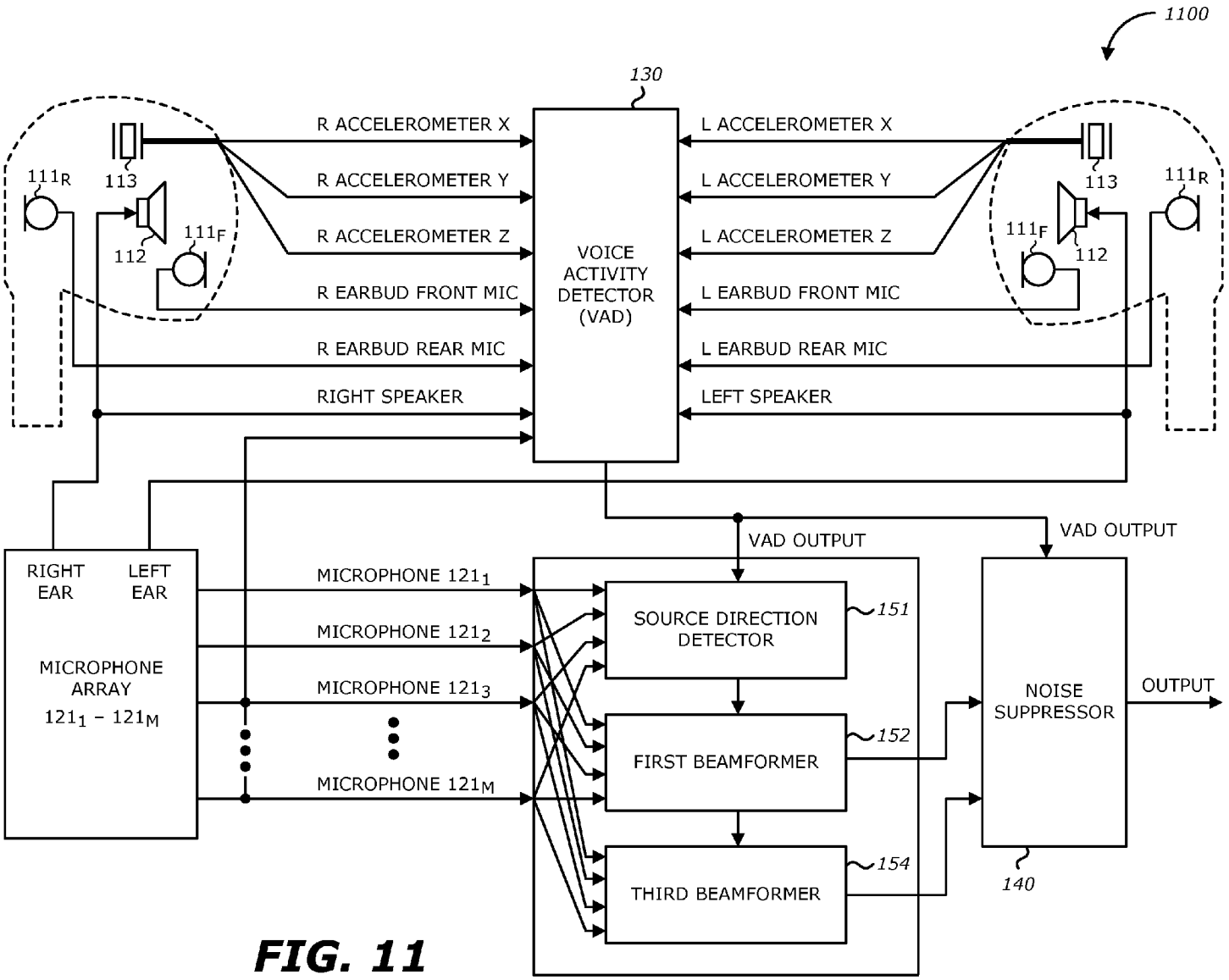
FIG. 11 illustrates a block diagram of a system detecting a user's voice activity according to a fifth embodiment of the invention.

FIG. 11 illustrates a block diagram of a system detecting a user's voice activity according to a fifth embodiment of the invention. System 1100 is similar to the system 900 in FIG. 9 but in lieu of the second beamformer 153, system 1100 includes a third beamformer 154 to provide a noise estimation of the environment noise that is present in the acoustic signals from the microphone array $121_1$-$121_M$. The third beamformer 154 differs from the second beamformer 153 in that the third beamformer 154 is used to detect the strongest environmental noise. The third beamformer 154 may then be adaptively steered in the direction of the strongest environmental noise location when the VAD output is set to indicate that the user's speech is not detected. Accordingly, the third beamformer 154 provides an estimate of the main environmental noise that is present in the acoustic signals from the microphone array $121_1$-$121_M$. It is understood that the third beamformer 154 may also be adaptively steered to in a direction of a plurality of strongest environmental noise locations. In this embodiment, the noise suppressor 140 may suppress the noise included in the main speech signal as outputted by the first beamformer 152 based on the noise estimate of the main environmental noise as outputted from the third beamformer 154 and the VAD output received from the VAD 130.

Figure 12:
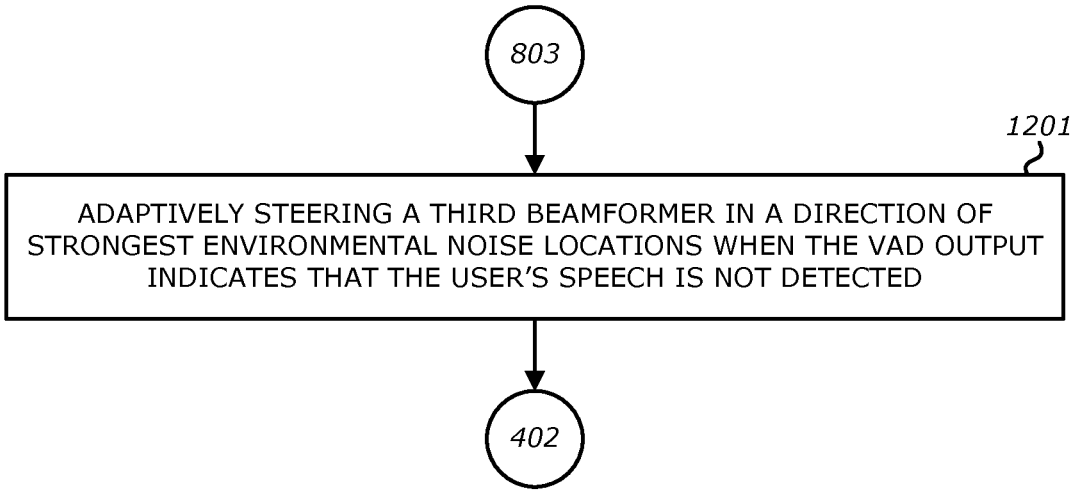
FIG. 12 illustrates a flow diagram of an example method of detecting a user's voice activity according to the fifth embodiment of the invention.

FIG. 12 illustrates a flow diagram of an example method of detecting a user's voice activity according to the fifth embodiment of the invention. In this embodiment, after the first beamformer is adaptively steered in the direction of the detected user's speech source at Block 803 in FIG. 8, the third beamformer 154 is adaptively steered in a direction of the strongest environmental noise location when the VAD output indicates that the user's speech is not detected. In this embodiment, the noise suppressor 140 receives a noise estimate of the main environmental noise from the third beamformer 154 and suppresses the noise included in the main speech signal as outputted from the first beamformer 152 based on the output from the third beamformer 154 and the VAD output.

Figure 13:
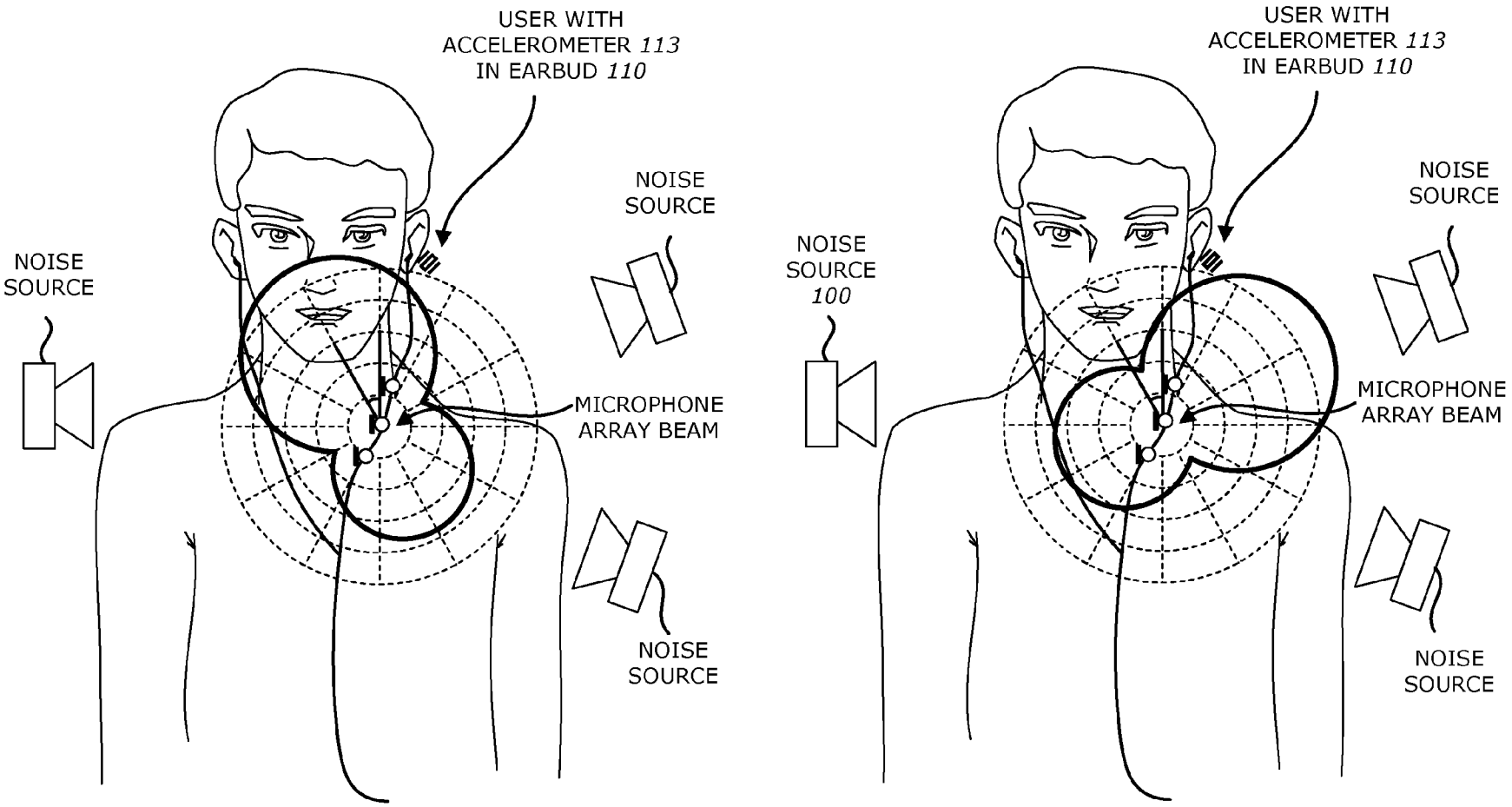
FIG. 13 illustrates an example of the headset in use according to the fifth embodiment of the invention.

FIG. 13 illustrates an example of the headset in use according to the fifth embodiment of the invention. In FIG. 13, the voice tracking using the first beamformer 152 (e.g., left side of FIG. 13) and noise tracking using the third beamformer 154 (e.g., right side of FIG. 13) are illustrated. When the VAD output is set to 1, the first beamformer 152 is adaptively steered in the direction of the user's mouth (e.g., left side of FIG. 13). When the VAD output is set to 0, the third beamformer 154 will detect the direction of the most significant noise source and be adaptively steered in this direction. Accordingly, this noise estimate may be passed together with the user's speech signal included in the output of the first beamformer 152 to the noise suppressor 140, which removes the noise based on the noise estimate and the VAD output. The noise suppressor 140 removes residual noise from main speech signal received from the first beamformer 152.

Figure 14:
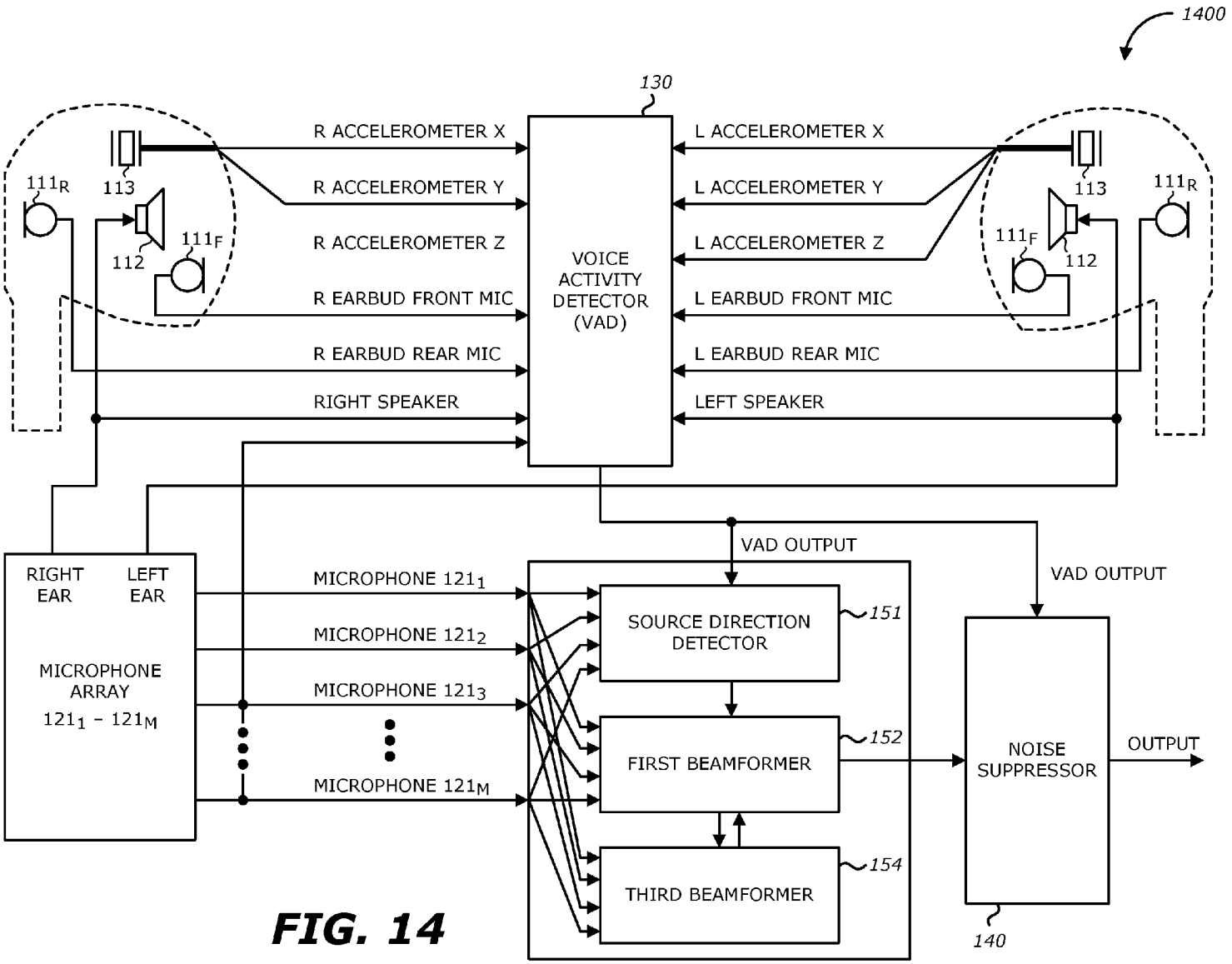
FIG. 14 illustrates a block diagram of a system detecting a user's voice activity according to a sixth embodiment of the invention.

FIG. 14 illustrates a block diagram of a system detecting a user's voice activity according to a sixth embodiment of the invention. System 1400 is similar to the system 1100 in FIG. 11, in that the third beamformer 154 is used to detect the direction of the strongest environmental noise location when the VAD output indicates that the user's speech is not detected (e.g., VAD output is set to 0). However, in system 1400, the direction of the strongest environmental noise location detected by the third beamformer 154 is provided to the first beamformer 152 and the nulls of the first beamformer 152 may be adaptively steered towards the direction of the strongest environmental noise location while keeping the main beam of the first beamformer 152 in the direction of the user's mouth as detected when the VAD output is set to 1. The adaptive steering of the nulls of the first beamformer 152 may be performed when the VAD output is 1 or 0. Further, it is understood that the strongest environmental noise location may include one or more directions. In this embodiment, the noise suppressor 140 receives the main speech signal being outputted from the first beamformer 152. This main speech signal may include the acoustic signals from the microphones $\mathbf{121}_1$-$\mathbf{121}_M$ as captured by the first beamformer 152 having a main beam directed to the user's mouth and nulls directed to the location(s) of the main environmental noise(s). In this embodiment, the noise suppressor 140 suppresses the noise included in the main speech signal outputted from the first beamformer 152 based on the VAD output.

Figure 15:
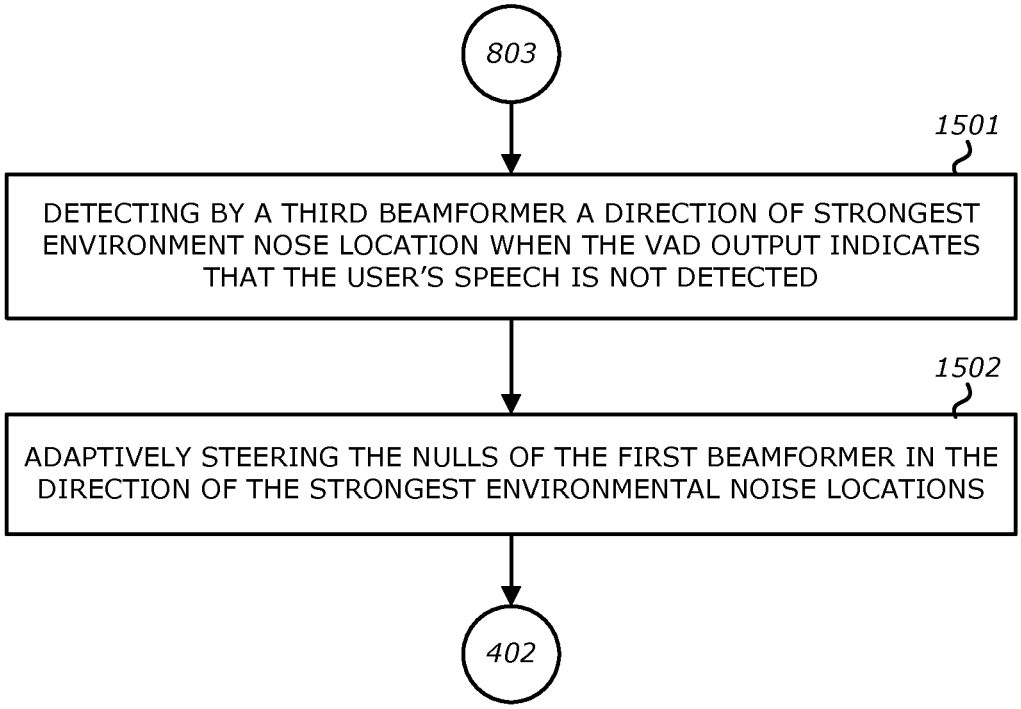
FIG. 15 illustrates a flow diagram of an example method of detecting a user's voice activity according to the sixth embodiment of the invention.

FIG. 15 illustrates a flow diagram of an example method of detecting a user's voice activity according to the sixth embodiment of the invention. In this embodiment, after the first beamformer is adaptively steered in the direction of the detected user's speech source at Block 803 in FIG. 8, the third beamformer 154 detects a direction of the strongest environmental noise location when the VAD output indicates that the user's speech is not detected at Block 1501. At Block 1502, the null of first beamformer 152 is adaptively steered in a direction of the strongest environmental noise location. In some embodiments, the nulls of the first beamformer 152 may be adaptively steered in the directions of a plurality of detected strongest environmental noise locations, respectively. The adaptive steering of the null(s) of the first beamformer 152 in Block 1502 may be performed when the VAD output indicates that the user's speech is detected or when the VAD output indicates that the user's speech is not detected. In this embodiment, the noise suppressor 140 suppresses the noise included in the main speech signal as outputted from the first beamformer 152 based on the VAD output.

Figure 16:
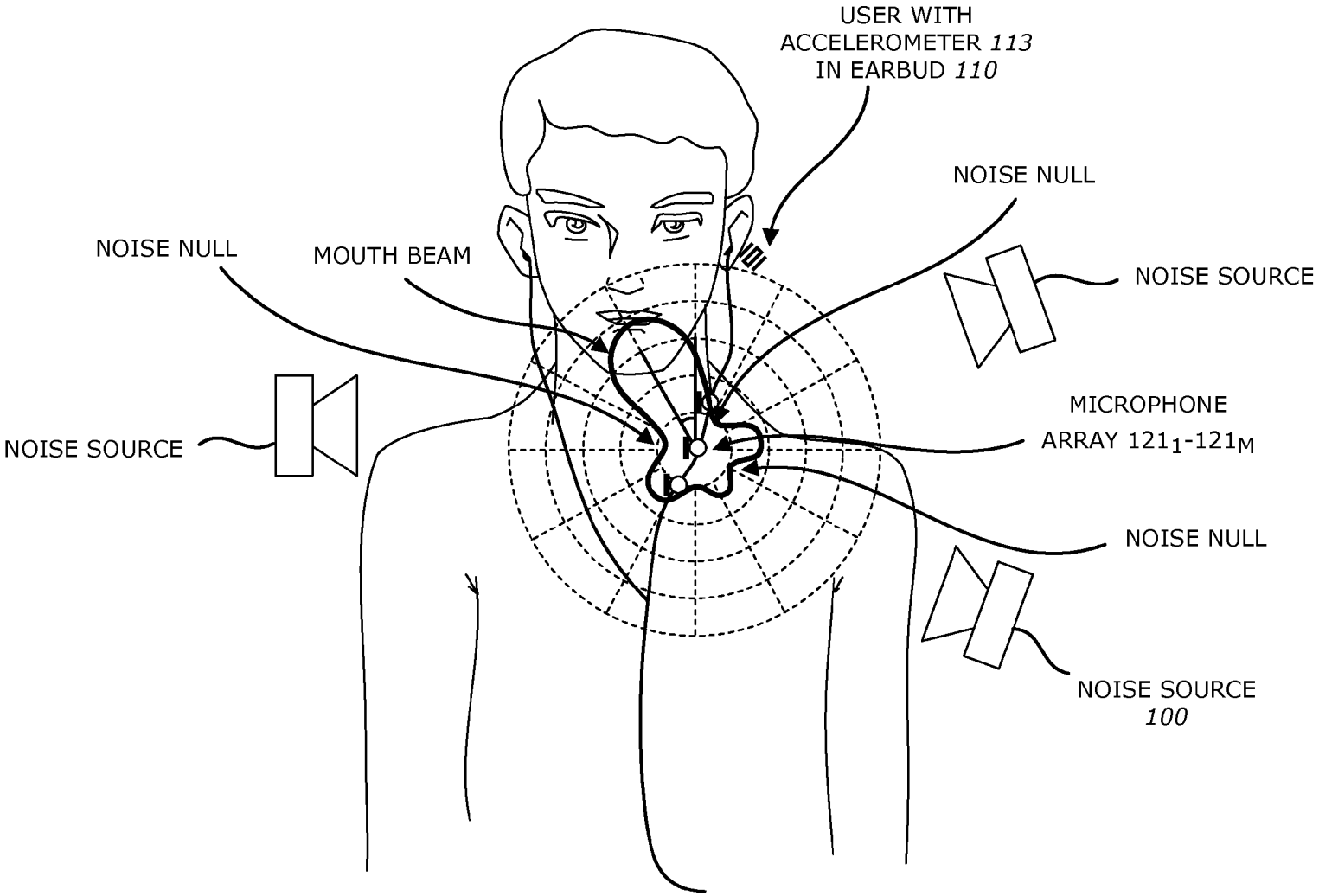
FIG. 16 illustrates an example of the headset in use according to the sixth embodiment of the invention.

FIG. 16 illustrates an example of the headset in use according to the sixth embodiment of the invention. As shown in FIG. 16, when the VAD output is set to 1, the first beamformer 152 is adaptively steered such that the main beam is directed towards the user's mouth and maintained in that direction when the VAD output is set to 0. The third beamformer 154 detects the directions of the main environment noise locations when the VAD output is set to 0. Using the directions detected by the third beamformer 154, the nulls of the first beamformer 152 are adaptively steered in these directions of the main environment noise locations. Accordingly, the first beamformer 152 emphasizes the user's speech using the main beam and deemphasizes the noise locations using the nulls.

Figure 17:
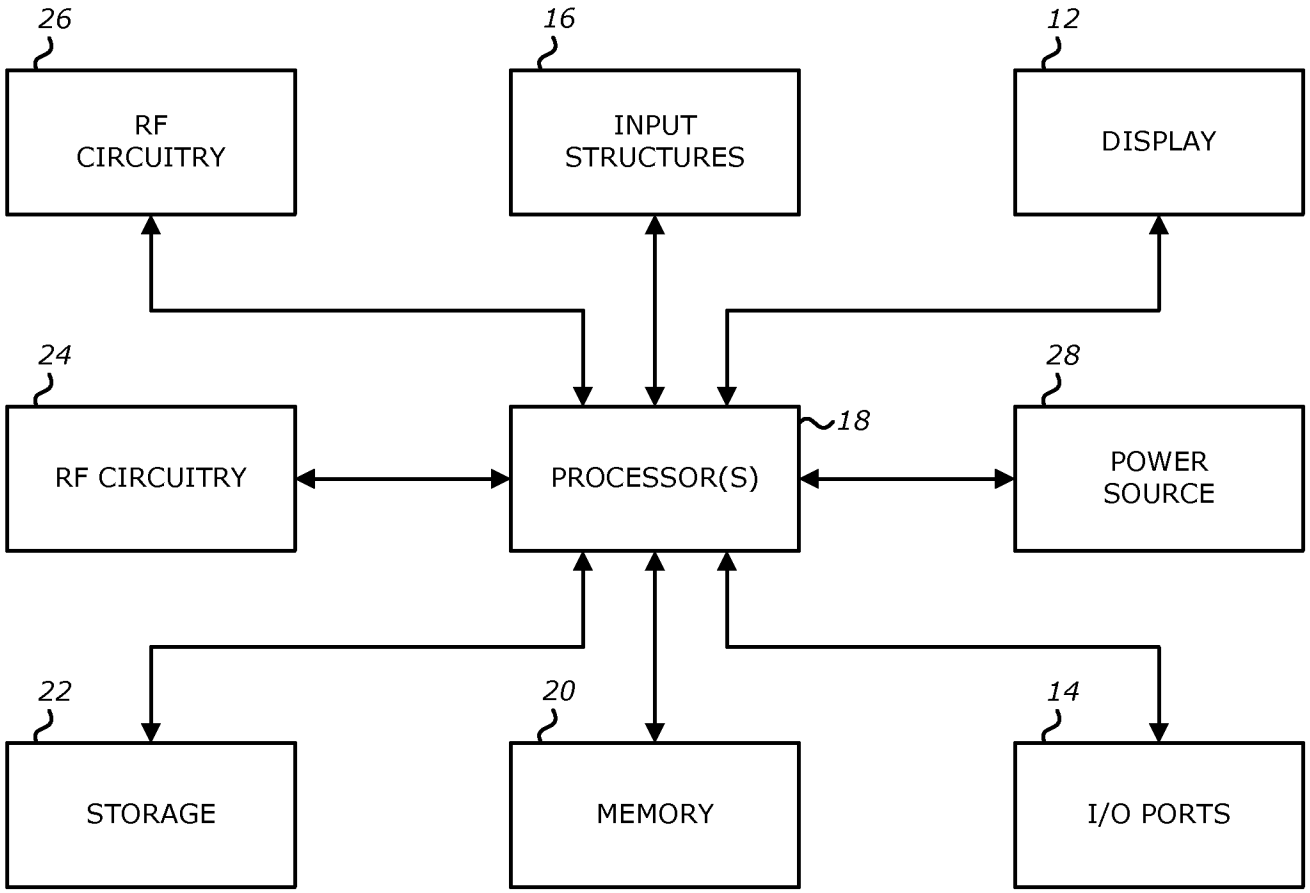
FIG. 17 is a block diagram of exemplary components of an electronic device detecting a user's voice activity in accordance with aspects of the present disclosure.
Figure 18:
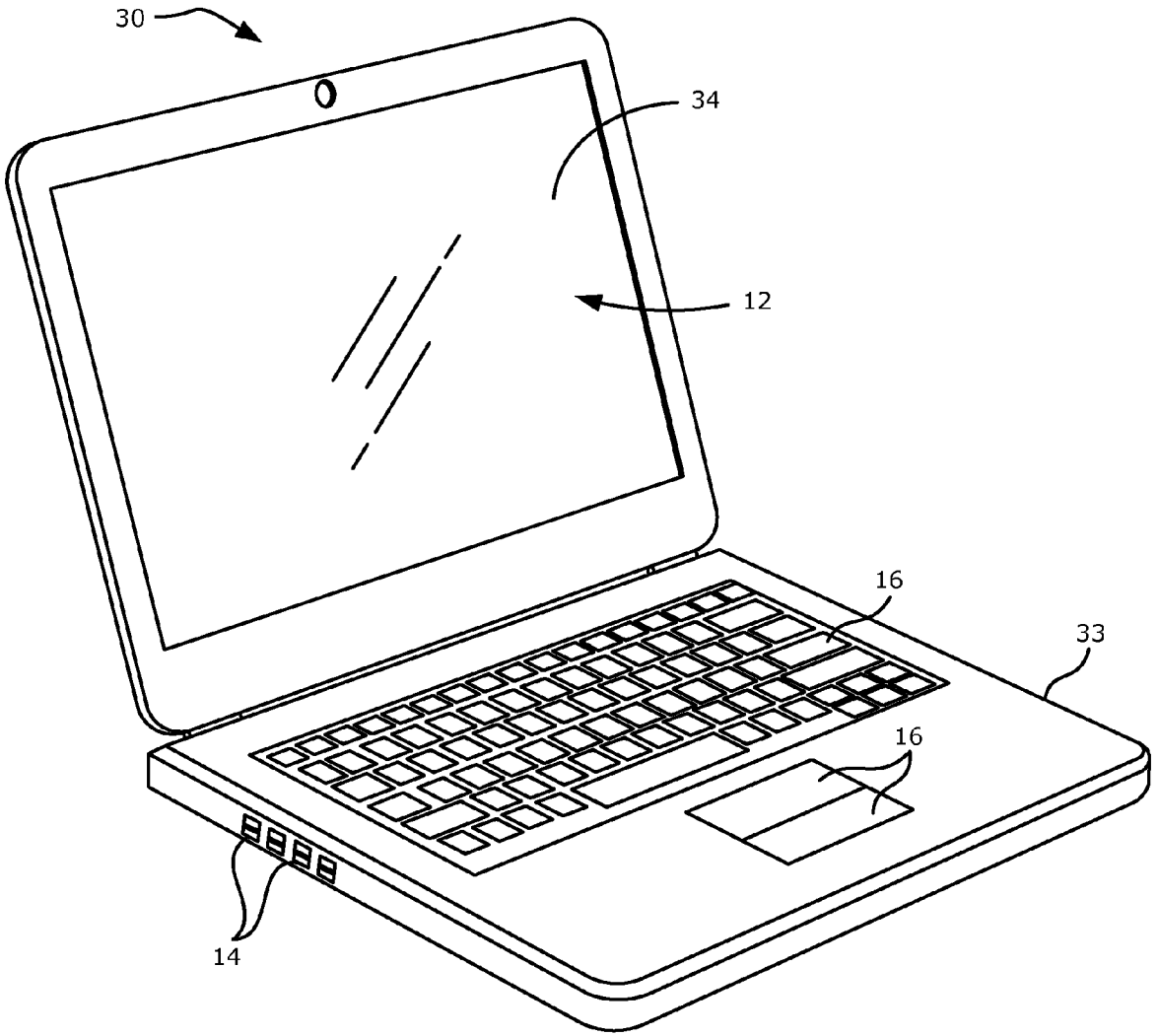
FIG. 18 is a perspective view of an electronic device in the form of a computer, in accordance with aspects of the present disclosure.
Figure 19:
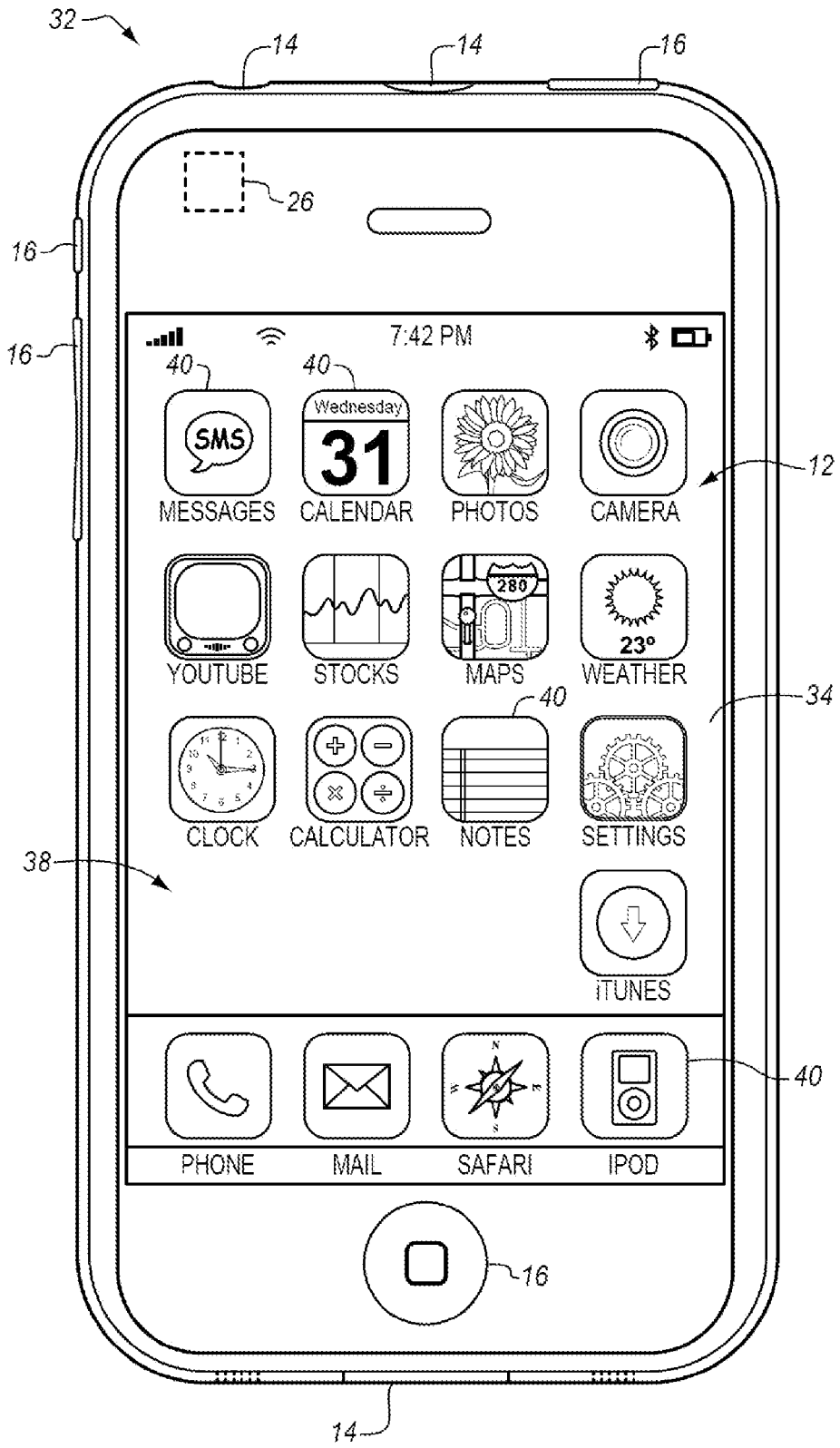
FIG. 19 is a front-view of a portable handheld electronic device, in accordance with aspects of the present disclosure.
Figure 20:
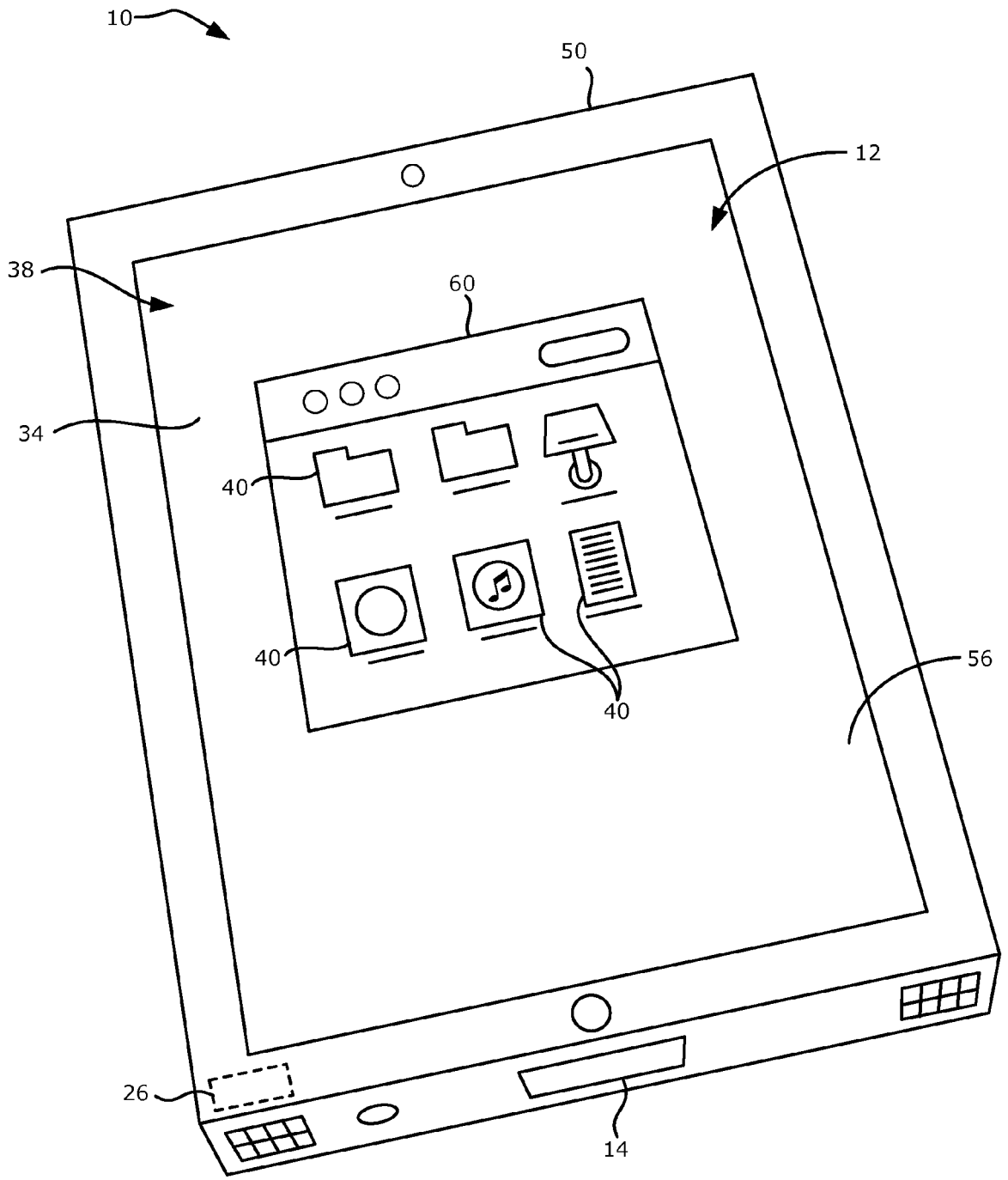
FIG. 20 is a perspective view of a tablet-style electronic device that may be used in conjunction with aspects of the present disclosure.

A general description of suitable electronic devices for performing these functions is provided below with respect to FIGS. 17-20. Specifically, FIG. 17 is a block diagram depicting various components that may be present in electronic devices suitable for use with the present techniques. FIG. 18 depicts an example of a suitable electronic device in the form of a computer. FIG. 19 depicts another example of a suitable electronic device in the form of a handheld portable electronic device. Additionally, FIG. 20 depicts yet another example of a suitable electronic device in the form of a computing device having a tablet-style form factor. These types of electronic devices, as well as other electronic devices providing comparable voice communications capabilities (e.g., VoIP, telephone communications, etc.), may be used in conjunction with the present techniques.

Keeping the above points in mind, FIG. 17 is a block diagram illustrating components that may be present in one such electronic device 10, and which may allow the device 10 to function in accordance with the techniques discussed herein. The various functional blocks shown in FIG. 17 may include hardware elements (including circuitry), software elements (including computer code stored on a computer-readable medium, such as a hard drive or system memory), or a combination of both hardware and software elements. It should be noted that FIG. 17 is merely one example of a particular implementation and is merely intended to illustrate the types of components that may be present in the electronic device 10. For example, in the illustrated embodiment, these components may include a display 12, input/output (I/O) ports 14, input structures 16, one or more processors 18, memory device(s) 20, non-volatile storage 22, expansion card(s) 24, RF circuitry 26, and power source 28.

FIG. 18 illustrates an embodiment of the electronic device 10 in the form of a computer 30. The computer 30 may include computers that are generally portable (such as laptop, notebook, tablet, and handheld computers), as well as computers that are generally used in one place (such as conventional desktop computers, workstations, and servers). In certain embodiments, the electronic device 10 in the form of a computer may be a model of a MacBook™, MacBook™ Pro, MacBook Air™, iMac™, Mac Mini, or Mac Pro™, available from Apple Inc. of Cupertino, Calif. The depicted computer 30 includes a housing or enclosure 33, the display 12 (e.g., as an LCD 34 or some other suitable display), I/O ports 14, and input structures 16.

The electronic device 10 may also take the form of other types of devices, such as mobile telephones, media players, personal data organizers, handheld game platforms, cameras, and/or combinations of such devices. For instance, as generally depicted in FIG. 19, the device 10 may be provided in the form of a handheld electronic device 32 that includes various functionalities (such as the ability to take pictures, make telephone calls, access the Internet, communicate via email, record audio and/or video, listen to music, play games, connect to wireless networks, and so forth). By way of example, the handheld device 32 may be a model of an iPod™, iPod™ Touch, or iPhone™ available from Apple Inc.

In another embodiment, the electronic device 10 may also be provided in the form of a portable multi-function tablet computing device 50, as depicted in FIG. 20. In certain embodiments, the tablet computing device 50 may provide the functionality of media player, a web browser, a cellular phone, a gaming platform, a personal data organizer, and so forth. By way of example, the tablet computing device 50 may be a model of an iPad™ tablet computer, available from Apple Inc.

While the invention has been described in terms of several embodiments, those of ordinary skill in the art will recognize that the invention is not limited to the embodiments described, but can be practiced with modification and alteration within the spirit and scope of the appended claims. The description is thus to be regarded as illustrative instead of limiting. There are numerous other variations to different aspects of the invention described above, which in the interest of conciseness have not been provided in detail. Accordingly, other embodiments are within the scope of the claims.

The invention claimed is:

1. A method of detecting a user's voice activity in a headset comprising:

generating by a voice activity detector (VAD) a VAD output based on (i) acoustic signals received from at least one microphone included in a pair of earbuds and (ii) data output by at least one accelerometer that is included in the pair of earbuds, the at least one accelerometer to detect vibration of the user's vocal chords, wherein the headset includes the pair of earbuds, wherein the VAD generates a microphone VAD (VADm) output based on the acoustic signals and generates an accelerometer VAD (VADa) output based on the data output by the at least one accelerometer, wherein the VAD output is based on the VADm output and the VADa output, wherein generating the VAD output comprises:

detecting speech included in the acoustic signals, and setting the VADm output to indicate that speech is detected in the acoustic signals, detecting the vibration of the user's vocal chords from the data output by the at least one accelerometer, and setting the VADa output to indicate that the user's voiced speech is detected, computing the coincidence of the VADm output being set to indicate detected speech in acoustic signals and the VADa output being set to indicate detected vibration of the user's vocal chords, and setting the VAD output to indicate that the user's voiced speech is detected if the coincidence is detected and setting the VAD output to indicate that the user's voiced speech is not detected if the coincidence is not detected.

2. The method of claim 1, wherein the at least one accelerometer is an accelerometer included in each of the earbuds.

3. The method of claim 1, wherein the at least one microphone included the pair of earbuds comprises: a front microphone and a rear microphone in each of the earbuds.

4. The method of claim 2, wherein generating the VAD output comprises:

computing a power envelope of at least one of x, y, z signals generated by the at least one accelerometer; and setting the VADa output to indicate that the user's voiced speech is detected if the power envelope is greater than a threshold and setting the VADa output to indicate that the user's voiced speech is not detected if the power envelope is less than the threshold.

5. The method of claim 2, wherein generating the VAD output comprises:

computing the normalized cross-correlation between any pair of x, y, z direction signals generated by the at least one accelerometer;

setting the VADa output to indicate that the user's voiced speech is detected if normalized cross-correlation is greater than a threshold within a short delay range, and setting the VADa output to indicate that the user's voiced speech is not detected if the normalized cross-correlation is less than the threshold.

6. The method of claim 1, wherein generating the VAD output comprises:

detecting unvoiced speech in the acoustic signals by:

analyzing at least one of the acoustic signals;

if an energy envelope in a high frequency band of the at least one of the acoustic signals is greater than a threshold, a VAD output for unvoiced speech (VADu) is set to indicate that unvoiced speech is detected; and setting the VAD output to indicate that the user's speech is detected if the voiced speech is detected or if the VADu is set to indicate that unvoiced speech is detected.

7. The method of claim 6, further comprising:

receiving acoustic signals from a microphone array by a fixed beamformer, the microphone array is included on a headset wire, wherein the headset includes the headset wire; and steering the fixed beamformer in a direction of the user's mouth during a normal wearing position of the headset.

8. The method of claim 7, further comprising:

receiving by a noise suppressor (i) a main speech signal from the fixed beamformer and (ii) the VAD output; and suppressing by the noise suppressor noise included in the main speech signal based on the VAD output.

9. The method of claim 6, further comprising:

receiving acoustic signals from a microphone array by a source direction detector, the microphone array is included on a headset wire, wherein the headset includes the headset wire;

detecting by the source direction detector the user's speech source based on the VAD output;

adaptively steering a first beamformer in a direction of the detected user's speech source when the VAD output is set to indicate that the user's speech is detected, the first beamformer outputting a main speech signal.

10. The method of claim 9, wherein detecting by the source direction detector the user's speech source based on the VAD output comprises:

determining a delay for a sound signal between microphones in the microphone array; and detecting the main acoustic source location using generalized cross correlation (GCC) or adaptive eigenvalue decomposition (AED).

11. The method of claim 9, detecting by the source direction detector the user's speech source based on the VAD output comprises:

steering the first beamformer over a range of directions; and calculating a power of the first beamformer for each direction in the range of directions, wherein the user's speech source is detected as a direction in the range of directions having the highest power.

12. The method of claim 9, further comprising:

adaptively steering a second beamformer with a null towards the user's speech source, wherein the second beamformer has a cardioid pattern, wherein the second beamformer outputs a signal representing environmental noise when the VAD output is set to indicate that the user's speech is not detected;

receiving by a noise suppressor (i) a main speech signal from the first beamformer, (ii) the signal representing the environmental noise from the second beamformer, and (iii) the VAD output; and suppressing by the noise suppressor noise included in the main speech signal based on the signal representing the environmental noise and the VAD output.

13. The method of claim 9, further comprising:

adaptively steering a second beamformer in a direction of strongest environmental noise location when the VAD output is set to indicate that the user's speech is not detected, wherein the second beamformer outputs a signal representing the strongest environmental noise;

receiving by a noise suppressor (i) a main speech signal from the first beamformer, (ii) the signal representing the strongest environmental noise outputted from the second beamformer, and (iii) the VAD output; and suppressing by the noise suppressor noise included in the main speech signal based on the signal representing the strongest environmental noise and the VAD output.

14. The method of claim 9, further comprising:

detecting by a second beamformer a direction of strongest environmental noise location when the VAD output is set to indicate that the user's speech is not detected;

adaptively steering the nulls of the first beamformer in the direction of the strongest environmental noise location to output a main speech signal from the first beamformer;

receiving by a noise suppressor (i) the main speech signal being output from the first beamformer, and (ii) the VAD output; and suppressing by the noise suppressor noise included in the main speech signal based on the VAD output.

15. The method of claim 1, wherein the at least one accelerometer has a sampling rate between 2000Hz to 6000Hz.

16. The method of claim 1, wherein the at least one accelerometer is tuned to be sensitive to a frequency band range that is below 3000Hz.

17. A system detecting a user's voice activity comprising:

a headset including a pair of earbuds, wherein the pair of earbuds includes at least one earbud microphone and at least one accelerometer to detect vibration of the user's vocal chords;

a voice activity detector (VAD) coupled to the headset, the VAD to generate a VAD output based on (i) acoustic signals received from the at least one earbud microphone and (ii) data output by the at least one accelerometer, wherein the VAD generates a microphone VAD (VADm) output based on the acoustic signals and generates an accelerometer VAD (VADa) output based on the data output by the at least one accelerometer, wherein the VAD output is based on the VADm output and the VADa output, wherein the VAD generates the VAD output by:

detecting speech included in the acoustic signals, and setting the VADm output to indicate that speech is detected in the acoustic signals, detecting the vibrations of the user's vocal chords from the data output by the at least one accelerometer, and setting the VADa output to indicate that the user's voiced speech is detected, computing the coincidence of the VADm output being set to indicate detected speech in acoustic signals and the VADa output being set to indicate detected vibrations of the user's vocal chords, and setting the VAD output to indicate that the user's voiced speech is detected if the coincidence is detected and setting the VAD output to indicate that the user's voiced speech is not detected if the coincidence is not detected; and a noise suppressor coupled to the headset and the VAD, the noise suppressor to suppress noise based on the VAD output.

18. The system of claim 17, wherein the at least one earbud microphone comprises a front microphone and a rear microphone in each of the earbuds.

19. The system of claim 17, wherein the VAD generates the VAD output by:

computing a power envelope of at least one of x, y, z signals generated by the at least one accelerometer; and setting the VADa output to indicate that the user's voiced speech is detected if the power envelope is greater than a threshold and setting the VADa output to indicate that the user's voiced speech is not detected if the power envelope is less than the threshold.

20. The system of claim 17, wherein the VAD generates the VAD output by:

computing the normalized cross-correlation between any pair of x, y, z direction signals generated by the at least one accelerometer; and setting the VADa output to indicate that the user's voiced speech is detected if normalized cross-correlation is greater than a threshold within a short delay range, and setting the VADa output to indicate that the user's voiced speech is not detected if the normalized cross-correlation is less than the threshold.

21. The system of claim 17, wherein generating the VAD output comprises:

detecting unvoiced speech in the acoustic signals by:

analyzing at least one of the acoustic signals;

if an energy envelope in a high frequency band of the at least one of the acoustic signals is greater than a threshold, a VAD output for unvoiced speech (VADu) is set to indicate that unvoiced speech is detected; and setting the VAD output to indicate that the user's speech is detected if the voiced speech is detected or if the VADu is set to indicate that unvoiced speech is detected.

22. The system of claim 17, further comprising:

a fixed beamformer receiving acoustic signals from a microphone array included on a headset wire, wherein the headset includes the headset wire, wherein the fixed beamformer is steered in a direction of the user's mouth during a normal wearing position of the headset to output a main speech signal.

23. The system of claim 22, wherein the noise suppressor suppresses the noise included in the main speech signal outputted by the fixed beamformer based on the VAD output.

24. The system of claim 17, further comprising:

a source direction detector receiving acoustic signals from a microphone array included on a headset wire and detecting the user's speech source based on the VAD output, wherein the headset includes the headset wire; and a first beamformer being adaptively steered in a direction of the detected user's speech source when the VAD output is set to indicate that the user's voiced speech is detected, wherein the first beamformer outputs a main speech signal.

25. The system of claim 24, wherein the source direction detector detects the user's speech source based on the VAD output by:

determining a delay for a sound signal between microphones in the microphone array; and detecting the main acoustic source location using generalized cross correlation (GCC) or adaptive eigenvalue decomposition (AED).

26. The system of claim 24, wherein the source direction detector detects the user's speech source based on the VAD output by:

steering the first beamformer over a range of directions; and calculating a power of the first beamformer for each direction in the range of directions, wherein the user's speech source is detected as a direction in the range of directions having the highest power.

27. The system of claim 24, further comprising:

a second beamformer being adaptively steered to direct a null of the second beamformer towards the user's speech source, wherein the second beamformer has a cardioid pattern, wherein the second beamformer outputs a signal representing environmental noise when the VAD output is set to indicate that the user's voiced speech is not detected, wherein the noise suppressor suppresses the noise included in the main speech signal based the signal representing environmental noise outputted from the second beamformer and the VAD output.

28. The system of claim 24, further comprising:

a second beamformer being adaptively steered in a direction of strongest environmental noise location when the VAD output is set to indicate that the user's speech is not detected, wherein the second beamformer outputs a signal representing the strongest environmental noise, wherein the noise suppressor suppresses the noise included in the main speech signal based on the signal representing the strongest environmental noise outputted from the second beamformer and the VAD output.

29. The system of claim 24, further comprising:

a second beamformer detecting a direction of strongest environmental noise location when the VAD output is set to indicate that the user's speech is not detected, wherein the nulls of the first beamformer are adaptively steered in the direction of the strongest environmental noise location.

30. The system of claim 24, wherein the VAD and the noise suppressor are included in an electronic device.

* * * * *